US011737504B2

(12) United States Patent
Lee et al.

(10) Patent No.: US 11,737,504 B2
(45) Date of Patent: Aug. 29, 2023

(54) FRONT COVER FOR HELMETS, SHELL FOR HELMET AND HELMET INCLUDING THE SAME

(71) Applicant: Kido Sports Co., Ltd., Seoul (KR)

(72) Inventors: Young Chong Lee, Seoul (KR); Geun Ho Jwa, Seoul (KR)

(73) Assignee: KIDO SPORTS CO., LTD., Seoul (KR)

( * ) Notice: Subject to any disclaimer, the term of this patent is extended or adjusted under 35 U.S.C. 154(b) by 0 days.

(21) Appl. No.: 17/254,435

(22) PCT Filed: Nov. 4, 2020

(86) PCT No.: PCT/KR2020/015336

§ 371 (c)(1),
(2) Date: Dec. 21, 2020

(87) PCT Pub. No.: WO2021/091228

PCT Pub. Date: May 14, 2021

(65) Prior Publication Data

US 2022/0408870 A1 Dec. 29, 2022

(30) Foreign Application Priority Data

Nov. 4, 2019 (KR) ..... 10-2019-0139835

(51) Int. Cl.
*A42B 3/32* (2006.01)

(52) U.S. Cl.
CPC ..... *A42B 3/326* (2013.01)

(58) Field of Classification Search
CPC ..... A42B 3/326
See application file for complete search history.

(56) References Cited

U.S. PATENT DOCUMENTS 4,689,836 A * 9/1987 Vitaloni ..... A42B 3/222 2/9
5,301,372 A * 4/1994 Matoba ..... A44B 1/32 24/702

(Continued)

FOREIGN PATENT DOCUMENTS

JP 2007332524 A 12/2007
JP 2010126871 A 6/2010

(Continued)

OTHER PUBLICATIONS

Office Action dated Dec. 18, 2019 in KR Application No. 10-2019-0139835.

(Continued)

*Primary Examiner* — Khaled Annis
(74) *Attorney, Agent, or Firm* — Panitch Schwarze Belisario & Nadel LLP

(57) ABSTRACT

A front cover for a helmet connectable to a shell for the helmet for covering an upper side, a rear side, and two sides of the head of a wearer so as to protect the upper side, the rear side, and two sides of the head of the wearer, is provided. The front cover includes a jaw protection portion configured to protect the wearer's jaw when the front cover is connected to the shell, and a jaw mediation portion connected to the jaw protection portion and configured to serve to mediate the jaw protection portion and the shell by being connected to the shell. When the jaw protection portion is connected to the shell by the jaw mediation portion, the jaw protection portion is rotatable based on the shell.

18 Claims, 21 Drawing Sheets

(56) References Cited

U.S. PATENT DOCUMENTS

| | | | | |
|---|---|---|---|---|
| 7,398,561 | B2 * | 7/2008 | Kim | A42B 3/222 2/424 |
| 8,011,025 | B2 * | 9/2011 | Lee | A42B 3/326 2/424 |
| 10,869,521 | B2 * | 12/2020 | Kim | A42B 3/227 |
| 2003/0182716 | A1 * | 10/2003 | Wu | A42B 3/326 2/424 |
| 2006/0064799 | A1 * | 3/2006 | Dion | A42B 3/326 2/424 |
| 2008/0216215 | A1 * | 9/2008 | Lee | A42B 3/326 2/10 |
| 2010/0132095 | A1 * | 6/2010 | Gafforio | A42B 3/326 2/424 |
| 2011/0302701 | A1 * | 12/2011 | Kuo | A42B 3/326 2/424 |
| 2012/0284905 | A1 * | 11/2012 | Kim | A42B 3/226 2/424 |
| 2012/0284906 | A1 * | 11/2012 | Kuo | A42B 3/223 2/424 |
| 2018/0103710 | A1 * | 4/2018 | Kim | A42B 3/326 |
| 2018/0213877 | A1 * | 8/2018 | Liao | A42B 3/225 |
| 2020/0113268 | A1 * | 4/2020 | Liao | A42B 3/223 |
| 2020/0146387 | A1 * | 5/2020 | Nimura | A42B 3/205 |
| 2021/0274877 | A1 * | 9/2021 | Liao | A42B 3/326 |
| 2022/0216681 | A1 * | 7/2022 | Alfaro, Jr. | H01B 17/56 |

FOREIGN PATENT DOCUMENTS

| | | | |
|---|---|---|---|
| KR | 20010054381 | A | 7/2001 |
| KR | 20130036165 | A | 4/2013 |
| KR | 20140081791 | A | 7/2014 |

OTHER PUBLICATIONS

Notice of Allowance dated Aug. 18, 2020 in KR Application No. 10-2019-0139835.

International Search Report dated Feb. 15, 2021 in International Application No. PCT/KR2020/015336.

* cited by examiner

FRONT COVER FOR HELMETS, SHELL FOR HELMET AND HELMET INCLUDING THE SAME

CROSS-REFERENCE TO RELATED APPLICATION

This application is a Section 371 of International Application No. PCT/KR2020/015336, filed Nov. 4, 2020, which claims priority under 35 U.S.C. § 119(b) to Korean Application No. 10-2019-0139835, filed Nov. 4, 2019, the disclosures of each of which are incorporated herein by reference in their entireties.

BACKGROUND

1. Field of the Invention

The present invention relates to a front cover for helmets, and more particularly, to a type-variable helmet that can be changed into several types and used.

2. Discussion of Related Art

Helmets for motorcycles are used to protect the head and face of a user riding a motorcycle. Such helmets for motorcycles are released in various types so that various factors such as purpose, usage, and preference of users can be considered. To briefly list each type for specific explanation, a full-face type helmet (Korean Patent Registration Publication No. 10-1995947, registered on Jun. 27, 2019) is the most basic helmet that wraps around the entire head and face of an occupant. A half-face type helmet is a lightweight helmet that covers only the head. An open-face type helmet (European Patent Registration Publication No. 2555645, registered on Mar. 19, 2014) is a median-type helmet between the full-face type helmet and the half-face type helmet and is a helmet that surrounds the head and part of the face to expose the jaw part. A system helmet is the same as the full-face type helmet in that it covers the entire head and face but has a difference in that the part that covers the jaw can be opened and closed.

A wearer may purchase and use one of the above types of helmets in consideration of the purpose of use and preference. However, when the wearer is somewhat tired of the purchased helmet or is exposed to an environment that is not suitable for wearing the purchased helmet, a problem has arisen that a new type of helmet has to be separately purchased.

SUMMARY OF THE INVENTION

The present invention is directed to a front cover for helmets, a shell for a helmet, and a helmet including the same so that a type-variable helmet, which may be changed into several shapes, can be implemented.

The problem to be solved by the present invention is not limited to the above-described problem, and the problems that are not mentioned will be clearly understood by those of ordinary skill in the art from the present specification and the accompanying drawings.

According to an aspect of the present invention, there is provided a front cover for a helmet connectable to a shell for the helmet for covering an upper side, a rear side, and two sides of the head of a wearer so as to protect the upper side, the rear side, and two sides of the head of the wearer, the front cover including a jaw protection portion configured to protect the wearer's jaw when the front cover is connected to the shell, and a jaw mediation portion connected to the jaw protection portion and configured to serve to mediate the jaw protection portion and the shell by being connected to the shell, wherein, when the jaw protection portion is connected to the shell by the jaw mediation portion, the jaw protection portion is rotatable on the basis of the shell.

The jaw mediation portion may be rotatably connected to the jaw protection portion.

The jaw mediation portion may be connected to at least one end of both ends of the jaw protection portion so as to protrude from an inner surface of the end of the jaw protection portion.

The front cover may further include a shield portion connected to the jaw protection portion so that, when the front cover is connected to the shell, the wearer's eyes are allowed to be protected, wherein the shield portion is detachably attached to the jaw protection portion.

The jaw protection portion may include a jaw protection body portion configured to protect the wearer's jaw when the front cover is connected to the shell, a jaw protection seating portion connected to at least one end of the jaw protection body portion and configured to provide a certain area in which the shield portion is seated, and a coupling portion configured to determine whether to connect the shield portion and the jaw protection seating portion through position movement, and when the coupling portion is in a locked position, the coupling portion may limit position movement of the shield portion so that the shield portion connected to the jaw protection seating portion is not separated from the jaw protection seating portion, and when the coupling portion is in a released portion, the coupling portion may limit position movement of the shield portion so that the shield portion connected to the jaw protection seating portion is separated from the jaw protection seating portion.

When the shield portion is connected to the jaw protection seating portion, the shield portion may be rotatable on the basis of the jaw protection seating portion, and when the shield portion is located in an open position, the coupling portion may be partially concealed by the shield portion and connected to the jaw protection seating portion so that the remaining part is exposed to the outside.

The jaw protection portion may further include a jaw elastic portion configured to provide an elastic force to the coupling portion so that, when no external force is applied to the coupling portion, the coupling portion is held in the locked position.

The shield portion may include a shield body portion and a first protrusion protruding from an inner surface of the shield body portion seated on the jaw protection seating portion, and the jaw protection seating portion may include a first guide portion that is recessed to a certain depth so that the first protrusion is inserted and moved in position so that the shield portion is rotatable with respect to the jaw protection seating portion, and when the coupling portion is in the locked position, part of the coupling portion may be disposed above the first guide portion, and the coupling portion may prevent the first protrusion inserted into the first guide portion from deviating from the first guide portion, and when the coupling portion is in the released position, all parts of the coupling portion may not be disposed above the first guide portion, and the first protrusion inserted into the first guide portion may be separable from the first guide portion.

The jaw protection portion may further include a first movement limiting portion that protrudes from the jaw protection seating portion and is positioned above the first guide portion so that, when the first protrusion is inserted into the first guide portion, the first protrusion may be prevented from deviating from the first guide portion, and when the shield portion is in the open position, the first protrusion may be positioned in a position corresponding to the coupling portion, and when the shield portion is in a protected position, the first protrusion may be positioned in a position corresponding to the first movement limiting portion.

The shield portion may further include a second protrusion protruding from an inner surface of the shield body portion seated on the jaw protection seating portion, and the jaw protection seating portion may include a second guide portion that is recessed to a certain depth so as to be spaced apart from the first guide portion so that the second protrusion is inserted and moved in position so that the shield portion is rotatable with respect to the jaw protection seating portion, and the jaw protection portion may further include a second movement limiting portion that protrudes from the jaw protection seating portion and is disposed above the second guide portion so that, when the second protrusion is inserted into the second guide portion, the second protrusion is prevented from deviating from the second guide portion, and when the shield portion is in the open position, the second protrusion may deviate from the upper side of the second guide portion, and when the shield portion is in a protected position, the second protrusion may be positioned in a position corresponding to the second movement limiting portion.

The jaw mediation portion may include a locking recess portion formed by part of a side surface of the jaw mediation portion being recessed so that, when the front cover is connected to the shell, a shell locking portion provided by the shell is inserted so that the front cover is prevented from being separated from the shell.

The jaw mediation portion may include a jaw mediation body portion and a shaft portion configured to connect the jaw mediation body portion and the jaw protection portion so that the jaw mediation body portion is rotatable with respect to the jaw protection portion, and the jaw mediation body portion may include a first jaw mediation body portion positioned adjacent to the jaw protection seating portion and a second jaw mediation body portion connected to the first jaw mediation body portion so that a bottom surface of the first jaw mediation body portion is included in a top surface of the second jaw mediation body portion, and the locking recess portion may be formed in the second jaw mediation body portion.

The front cover may further include a jaw locking portion that is connected to the jaw protection portion, rotates together with the jaw protection portion, and is movable in position on the basis of the jaw protection portion when the front cover is connected to the shell, wherein, when the jaw locking portion is in a free position, the jaw locking portion may not restrict rotation of the jaw protection portion with respect to the shell, and when the jaw locking portion is in a limited position, the jaw locking portion may restrict rotation of the jaw protection portion in a raised position with respect to the shell.

The jaw mediation portion may include a jaw mediation body portion, a shaft portion configured to connect the jaw mediation body portion and the jaw protection portion so that the jaw mediation body portion is rotatable with respect to the jaw protection portion, and a mediation limiting portion connected to the shaft portion, and when the jaw locking portion is in the free position, the jaw locking portion may not interfere with the mediation limiting portion when the jaw protection portion is rotated with respect to the shell, and when the jaw locking portion is in the limited position, the jaw locking portion may interfere with the mediation limiting portion so that the jaw protection portion in the raised position is not rotatable with respect to the shell.

The mediation limiting portion may include a first mediation limiting portion connected to the shaft portion and a second mediation limiting portion protruding from the first mediation limiting portion in one direction, and the jaw locking portion may include a first jaw locking portion for receiving an external force for positional movement, and a second jaw locking portion connected to the first jaw locking portion, and when the jaw protection portion is in the raised position, a jaw locking recess portion, into which the second mediation limiting portion is inserted, may be formed in the second jaw locking portion.

According to another aspect of the present invention, there is provided a shell for a helmet to which a front cover for the helmet (wherein the front cover includes a jaw protection portion allowing the jaw of a wearer to be protected and a jaw mediation portion connected to the jaw protection portion) is detachably attached and which covers an upper side, a rear side, and two sides of the head of the wearer so as to protect the upper side, the rear side, and two sides of the head of the wearer, the shell including a shell body portion configured to provide a certain space inside and communication with the outside so that the upper side, the rear side, and two sides of the head of the wearer are covered, a shell mediation portion that is connected to the shell body portion and connectable to the jaw mediation portion, and a shell locking portion that is connected to the jaw mediation portion so as to prevent the jaw mediation portion from being moved in a second direction that is opposite to a first direction and to prevent the jaw mediation portion from being separated from the shell mediation portion when the jaw mediation portion is moved in the first direction and connected to the shell mediation portion.

When the shell locking portion is in a protruding position, the shell locking portion may be inserted into a locking recess portion recessed into the jaw mediation portion, and when the shell locking portion is in a spaced position, the shell locking portion may be spaced apart from the locking recess portion.

The shell mediation portion may include a first shell mediation portion connected to the shell body portion and a second shell mediation portion connected to a top surface of the first shell mediation portion, and the first shell mediation portion may provide an inner space opened in a front direction of the shell body portion and in an upward direction of a side surface of the shell body portion, and the second shell mediation portion may provide an inner space opened in the front direction of the shell body portion and in the upward direction of the side surface of the shell body portion and may be connected to the first shell mediation portion so that an inner surface of the first shell mediation portion and an inner surface of the second shell mediation portion form multiple stages.

According to another aspect of the present invention, there is provided a helmet including a shell body portion configured to provide a certain space inside and communication with the outside so that the upper side, the rear side, and two sides of the head of the wearer are covered, a shell mediation portion connected to the shell body portion, a jaw protection portion allowing the jaw of the wearer to be protected and a jaw mediation portion connected to the jaw protection portion, connected to the shell mediation portion and configured to connect the jaw protection portion and the shell mediation portion, wherein the jaw mediation portion is rotatably connected to the jaw protection portion so that the jaw protection portion is rotatable with respect to the shell body portion.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
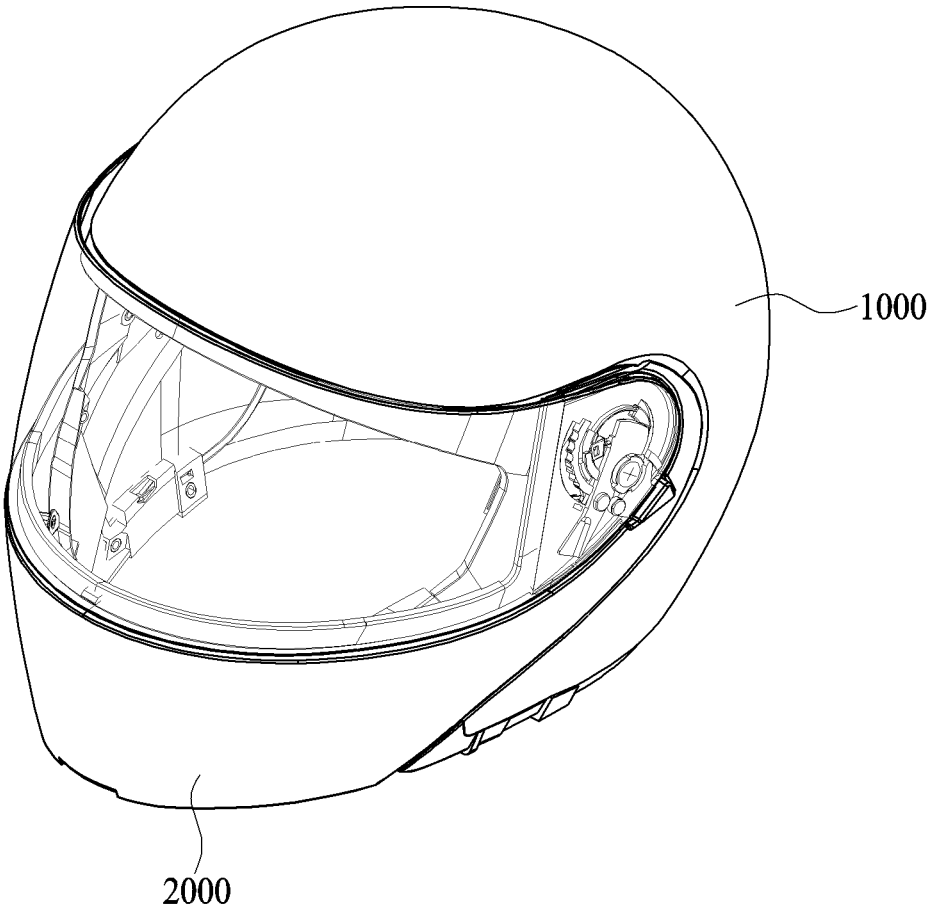
FIG. 1 is a perspective view of a helmet according to an embodiment of the present invention.

Hereinafter, specific embodiments of the present invention will be described in detail with reference to the accompanying drawings. However, the spirit of the present invention is not limited to presented embodiments, and those skilled in the art who understand the spirit of the present invention may easily propose another regressive invention or other embodiments included in the scope of the inventive concept by adding, changing, and deleting other elements within the scope of the inventive concept, but this will also be included in the spirit of the inventive concept.

Also, elements having the same function within the scope of the inventive concept shown in the drawings of each embodiment will be described using the same reference numerals.

In the present specification, when it is determined that a detailed description of a known configuration or function related to the present invention may obscure the subject matter of the present invention, a detailed description thereof will be omitted.

Figure 2:
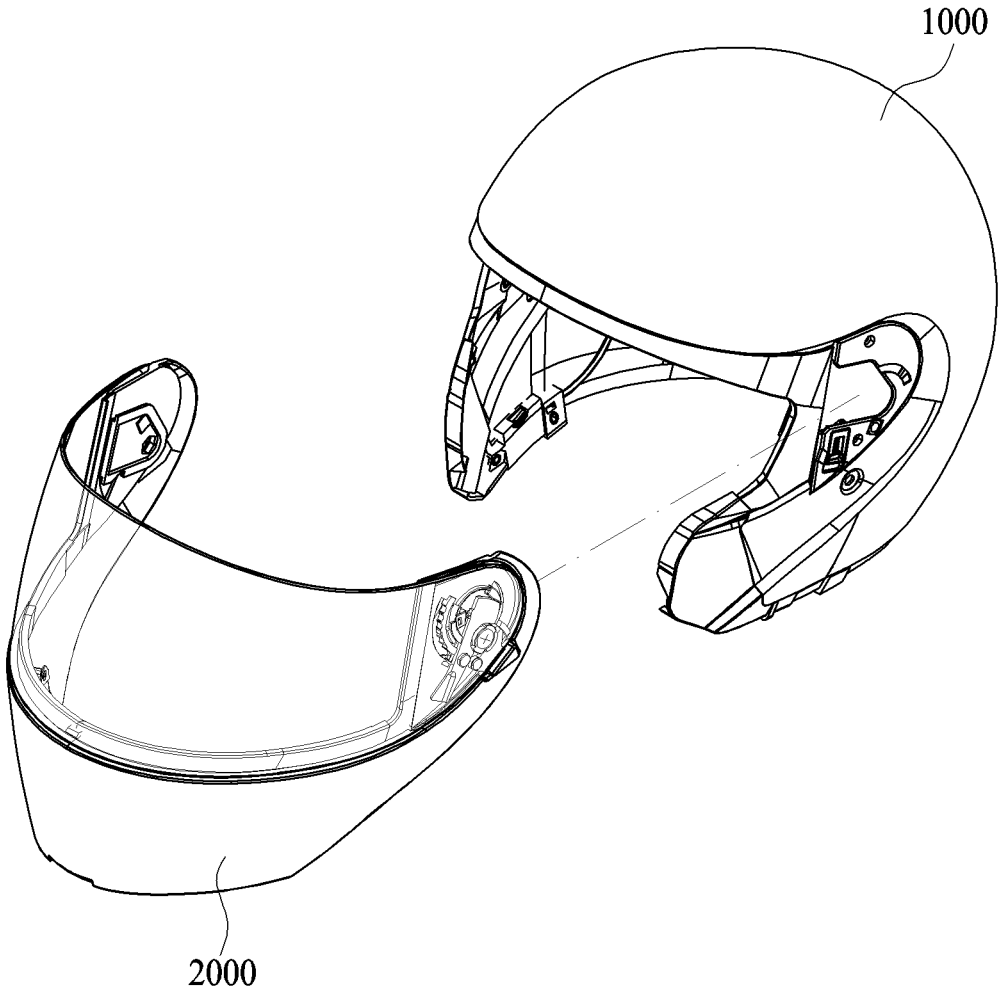
FIG. 2 is an exploded perspective view of a helmet according to an embodiment of the present invention.

FIG. 1 is a perspective view of a helmet according to an embodiment of the present invention, and FIG. 2 is an exploded perspective view of a helmet according to an embodiment of the present invention.

Referring to FIGS. 1 and 2, the helmet according to an embodiment of the present invention may include a shell 1000 for a helmet that covers the upper side, the rear side, and two sides of the head of a wearer so as to protect the upper side, the rear side, and two sides of the head of the wearer, and a front cover 2000 for helmets connected to the front of the shell 1000 for a helmet.

The front cover 2000 for helmets may be detachably attached to the shell 1000 for a helmet.

Alternatively, when the front cover 2000 for helmets is separated from the shell 1000 for a helmet, the wearer may wear only the shell 1000 for a helmet (open-face type helmet).

Alternatively, when the front cover 2000 for helmets is connected to the shell 1000 for a helmet, the wearer may wear the helmet (flip-up type helmet).

In this way, the wearer may wear protective equipment while changing the type thereof according to preference.

Hereinafter, the shell 1000 for a helmet and the front cover 2000 for helmets will be described in detail.

Figure 3:
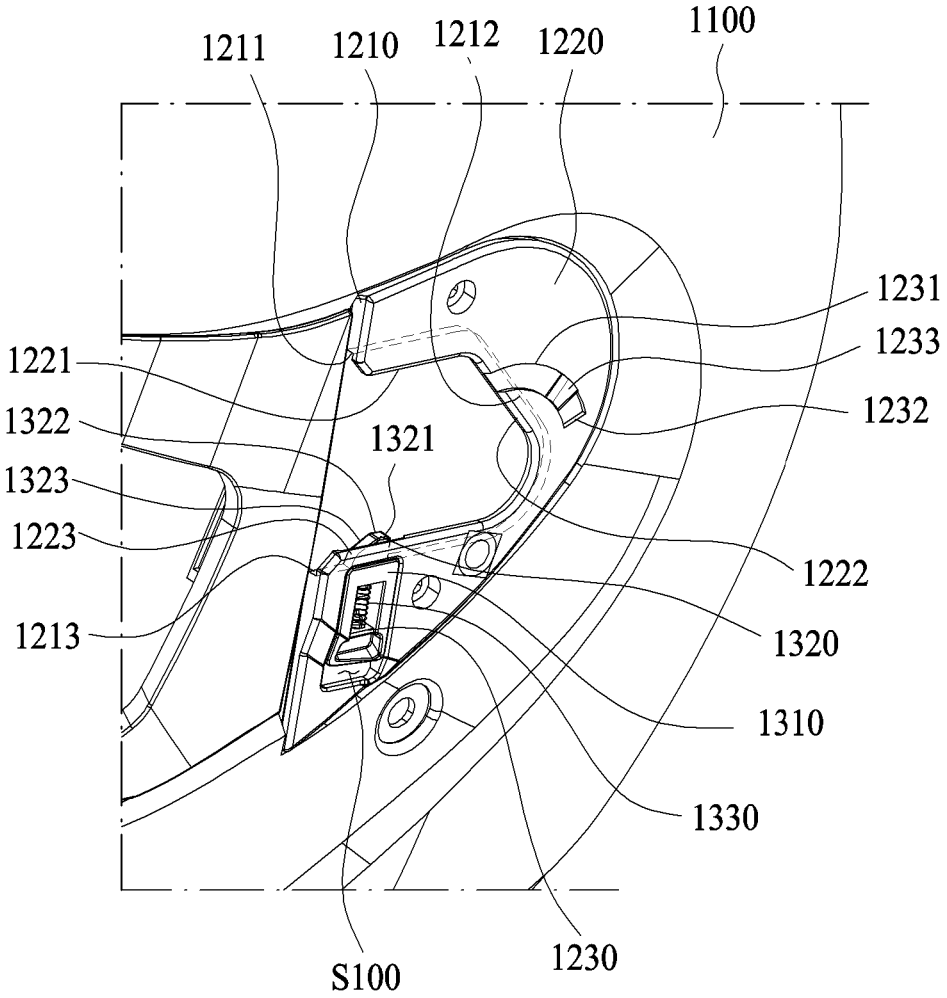
FIG. 3 is a view showing a shell for a helmet according to an embodiment of the present invention.

FIG. 3 illustrates the shell 1000 for a helmet according to an embodiment of the present invention.

Referring to FIG. 3, in the shell 1000 for a helmet according to an embodiment of the present invention, the front cover 2000 for helmets (wherein the front cover 2000 for helmets includes a jaw protection portion for covering the jaw of the wearer and a jaw mediation portion connected to the jaw protection portion.) may be detachably attached to the shell 1000 for a helmet, and the shell 1000 for a helmet that covers the upper side, the rear side, and two sides of the head of the wearer so as to protect the upper side, the rear side, and two sides of the wearer may include a shell body portion 1100 that provides a certain space inside and communicating with the outside so that the upper side, the rear side, and two sides of the head of the wearer can be covered, a shell mediation portion 1200 that is connected to the shell body portion 1100 and connectable to the jaw mediation portion, and a shell locking portion 1300 that is connected to the jaw mediation portion so as to prevent the jaw mediation portion from being moved in a second direction that is opposite to a first direction and to prevent the jaw mediation portion from being separated from the shell mediation portion 1200 when the jaw mediation portion is moved in the first direction and connected to the shell mediation portion 1200.

The wearer's head may be inserted into the shell body portion 1100 so that the shell body portion 1100 may protect the wearer's head from external shock.

The shell body portion 1100 may cover the upper side, the rear side and part of both cheeks of the wearer's head.

The shell mediation portion 1200 may be connected to two sides of the shell body portion 1100 and fixed thereto.

A jaw mediation portion (see 2200 of FIG. 4) that will be described later may be detachably attached to the shell mediation portion 1200.

The shell mediation portion 1200 may include a first shell mediation portion 210 connected to the shell body portion 1100, and a second shell mediation portion 1220 connected to a top surface of the first shell mediation portion 1210.

Also, the first shell mediation portion 1210 and the second shell mediation portion 1220 may be recessed into the shell mediation portion 1200 so that a moving space S100 can be formed.

Also, the shell mediation portion 1200 may further include an elastic support portion 1230 that protrudes from the second shell mediation portion 1220 and is positioned in the moving space S100.

The first shell mediation portion 1210 may provide an inner space opened in one direction (a front direction of the shell body portion 1100) and in an upward direction of a side surface of the shell body portion 1100.

Thus, the shell body portion 1100 may be exposed to the outside inside the first shell mediation portion 1210.

The second shell mediation portion 1220 may be connected to the top surface of the first shell mediation portion 1210.

The second shell mediation portion 1220 may provide an inner space opened in one direction (the front direction of the shell body portion 1100) and in an upward direction of a side surface of the shell body portion 1100.

Thus, the shell body portion 1100 may be exposed to the outside inside the second shell mediation portion 1220.

The second shell mediation portion 1220 may be arranged on part of the upper side of the inner space of the first shell mediation portion 1210.

Thus, an inner surface of the first shell mediation portion 1210 and an inner surface of the second shell mediation portion 1220 may form multiple stages.

Thus, when the jaw mediation portion 2200 is connected to and coupled to the shell mediation portion 1200, the jaw mediation portion 2200 may prevent the shell body portion 1100 from being separated from an upper direction of the side.

The shell mediation portion 1200 may include a first shell mediation portion 1210 connected to the shell body portion 1100 and a second shell mediation portion 1220 connected to the top surface of the first shell mediation portion 1210.

Here, the first shell mediation portion 1210 may provide an inner space opened in the front direction of the shell body portion 1100 and in the upward direction of the side surface of the shell body portion 1100.

Also, the second shell mediation portion 1220 may provide an inner space opened in the front direction of the shell body portion 1100 and in the upward direction of the side surface of the shell body portion 1100.

Also, the second shell mediation portion 1220 may be connected to the first shell mediation portion 1210 so that the inner surface of the first shell mediation portion 1210 and the inner surface of the second shell mediation portion 1220 can form multiple stages.

The inner surface of the first shell mediation portion 1210 may include a $(1\text{-}1)^{th}$ inner surface 1211, a $(1\text{-}2)^{th}$ inner surface 1212 connected to the first $(1\text{-}1)^{th}$ inner surface 1211 at a certain angle, and a $(1\text{-}3)^{th}$ inner surface 1213 having a certain angle with the $(1\text{-}2)^{th}$ inner surface 1212.

In an example, the $(1\text{-}1)^{th}$ inner surface 1211 and the $(1\text{-}3)^{th}$ inner surface 1213 may be parallel to each other.

However, the present invention is not limited thereto, and the relative arrangement of the $(1\text{-}1)^{th}$ inner surface 1211 and the $(1\text{-}3)^{th}$ inner surface 1213 may be variously modified at a level that is obvious to those skilled in the art.

The length of the $(1\text{-}3)^{th}$ inner surface 1213 may be greater than the length of the $(1\text{-}1)^{th}$ inner surface 1211.

Thus, the $(1\text{-}2)^{th}$ inner surface 1212 may be inclined.

The inner surface of the second shell mediation portion 1220 may include a $(2\text{-}1)^{th}$ inner surface 1221 adjacent to the $(1\text{-}1)^{th}$ inner surface 1211, a $(2\text{-}2)^{th}$ inner surface 1222 connected to the $(2\text{-}1)^{th}$ inner surface 1221 at a certain angle and adjacent to the $(1\text{-}2)^{th}$ inner surface 1212, and a $(2\text{-}3)^{th}$ inner surface 1223 adjacent to the $(1\text{-}3)^{th}$ inner surface 1213 and having a certain angle with the $(2\text{-}2)^{th}$ inner surface 1222.

In an example, the $(2\text{-}1)^{th}$ inner surface 1221 and the $(2\text{-}3)^{th}$ inner surface 1223 may be parallel to each other.

However, the present invention is not limited thereto, and the relative arrangement of the $(2\text{-}1)^{th}$ inner surface 1221 and the $(2\text{-}3)^{th}$ inner surface 1223 may be variously modified at a level that is obvious to those skilled in the art.

The length of the $(2\text{-}3)^{th}$ inner surface 1223 may be greater than the length of the $(2\text{-}13)^{th}$ inner surface 1221.

Thus, the $(2\text{-}2)^{th}$ inner surface 1222 may be inclined.

Part of the top surface of the second shell mediation portion 1220 may be recessed so that the shell guide portions 1221 and 1222 may be formed.

The shell guide portions 1221 and 1222 may be formed to be round.

A jaw protection protrusion 2190 that protrudes from the inner surface of the jaw protection seating portion 2120 to be described later may be inserted into the shell guide portions 1221 and 1222.

According to rotation of the jaw protection portion 2100 based on the shell 1000 for a helmet, the jaw protection protrusion 2190 may slide along the shell guide portions 1221 and 1222.

A shell protrusion 1233, with which the jaw protection protrusion 2190 sliding on the shell guide portions 1221 and 1222 may interfere, may be formed on the shell guide portions 1221 and 1222.

The shell protrusion 1233 may protrude from the top surface of the shell guide portions 1221 and 1222.

The shell guide portions 1221 and 1222 may extend from the $(1\text{-}2)^{th}$ inner surface 1212 and the $(2\text{-}2)^{th}$ inner surface 1222 to the backward direction of the second shell mediation portion 1220.

The shell guide portions 1221 and 1222 may include a first shell guide portion 1231 arranged toward the $(1\text{-}2)^{th}$ inner surface 1212 and the $(2\text{-}2)^{th}$ inner surface 1222 based on the shell protrusion 1233, and a second shell guide portion 1222 formed in the backward direction based on the shell protrusion 1233.

Since the inner space of the first shell mediation portion 1210 and the second shell mediation portion 1220 is opened in one direction, the jaw mediation portion 2200 to be described later may slide on the shell body portion 1100 and may be combined with the shell mediation portion 1200.

The first shell mediation portion 1210 and the second shell mediation portion 1220 may be integrally formed.

However, the present invention is not limited thereto, and a process of manufacturing the first shell mediation portion 1210 and the second shell mediation portion 1220 may be variously modified at a level that is obvious to those skilled in the art.

For example, the first shell mediation portion 1210 and the second shell mediation portion 1220 may be adhered to each other by an adhesive material as separate components.

The shell locking portion 1300 may be disposed in the moving space S100 and moved in position.

The shell locking portion 1300 may include a shell locking body portion 1310 arranged in the moving space S100, a shell locking protrusion 1320 that is connected to the shell locking body portion 1310 and located in the inner space of the first shell mediation portion 1210, and a shell elastic portion 1330 that provides an elastic force to the shell locking body portion 1310.

The shell locking body portion 1310 may be moved in position in the moving space S100.

The shell elastic portion 1330 may be connected to the elastic support portion 1230 and the shell locking body portion 1310 to apply an elastic force to the shell locking body portion 1310 according to the positional movement of the shell locking body portion 1310.

When the shell locking portion 1300 is in a protruding position, the shell locking protrusion 1320 may protrude from the $(1\text{-}3)^{th}$ inner surface 1213.

When an external force is applied to the shell locking body portion 1310 and the shell locking portion 1300 is moved from the protruding position to a spaced position, the shell locking protrusion 1320 may not protrude from the $(1\text{-}3)^{th}$ inner surface 1213 but may be disposed in the moving space S100.

At this time, the shell elastic portion 1330 may contract to store elastic energy.

When the external force is removed from the shell locking body portion 1310, the shell locking body portion 1310 may be raised by the elastic force of the shell elastic portion 1330 so that the shell locking protrusion 1320 may protrude from the $(1\text{-}3)^{th}$ inner surface 1213 again.

The shell locking protrusion 1320 may be formed to protrude in one direction from an upper end of the shell locking body portion 1310.

The shell locking protrusion 1320 may include a first locking surface 1321 orthogonal to the top of the shell locking body portion 1310 in an upward direction, a second locking surface 1322 having a certain angle with the first locking surface 1321 (for example, orthogonal), and a third locking surface 1323 inclined at a certain angle with the second locking surface 1322.

The third locking surface 1323 may be disposed in one direction in which the inner space of the shell mediation portion 1200 is opened with respect to the second locking surface 1322.

The third locking surface 1323 may allow the jaw mediation portion 2200 to be inserted into the inner space of the shell mediation portion 1200.

The first locking surface 1321 may prevent the jaw mediation portion 2200 from being separated from the shell mediation portion 1200 when the shell locking portion 1300 is in a protruding position.

Figure 4:
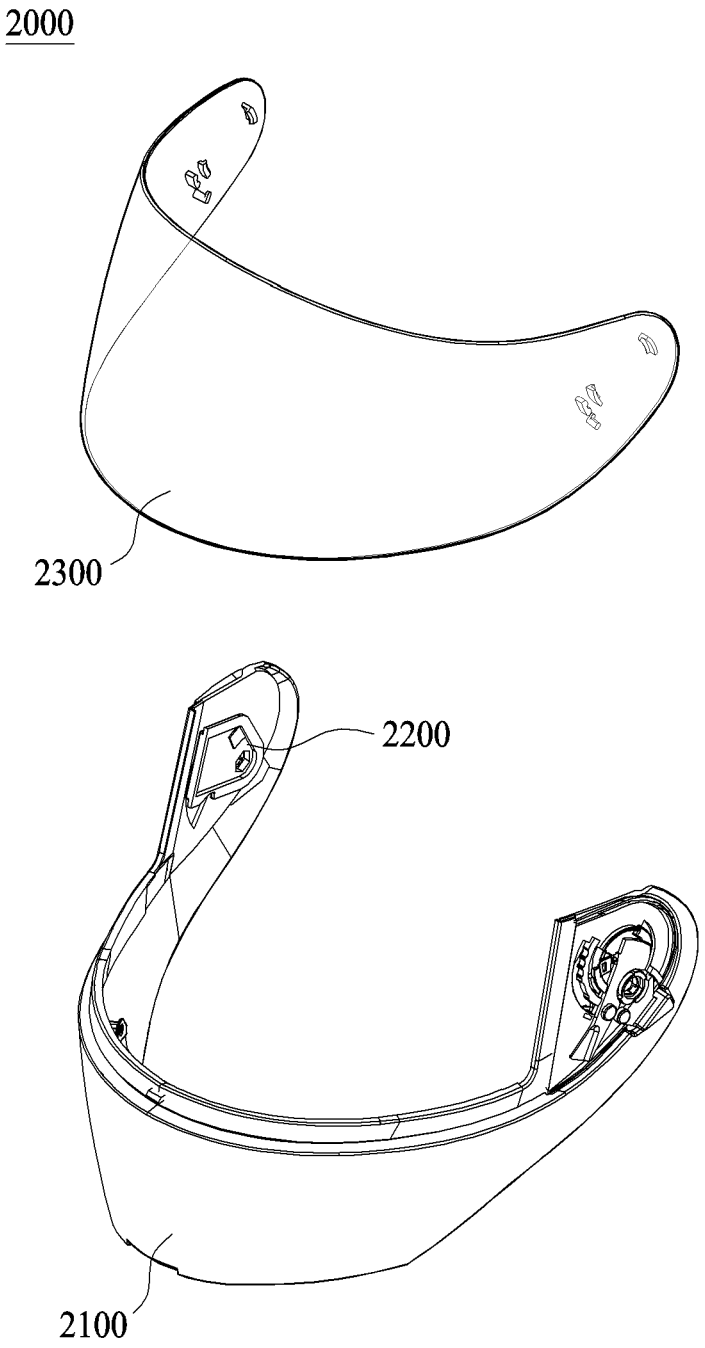
FIG. 4 is an exploded perspective view of a front cover for the helmet according to an embodiment of the present invention.

FIG. 4 is an exploded perspective view of the front cover for the helmet according to an embodiment of the present invention.

Referring to FIG. 4, the front cover 2000 for helmets according to an embodiment of the present invention may include a jaw protection portion 2100 that protects the wearer's jaw when the front cover 2000 for helmets is connected to the shell 1000 for a helmet, and a jaw mediation portion 2200 that is connected to the jaw protection portion 2100 and serves to mediate the jaw protection portion 2100 and the shell 1000 for a helmet to each other by being connected to the shell 1000 for a helmet.

In addition, the front cover 2000 for helmets may further include a shield portion 2300 connected to the jaw protection portion 2100 so that the wearer's eyes can be protected when the front cover 2000 for helmets is connected to the shell 1000 for a helmet.

Here, the shield portion 2300 may be detachably attached to the jaw protection portion 2100.

Hereinafter, the front cover 2000 for helmets will be described in detail.

Figure 5:
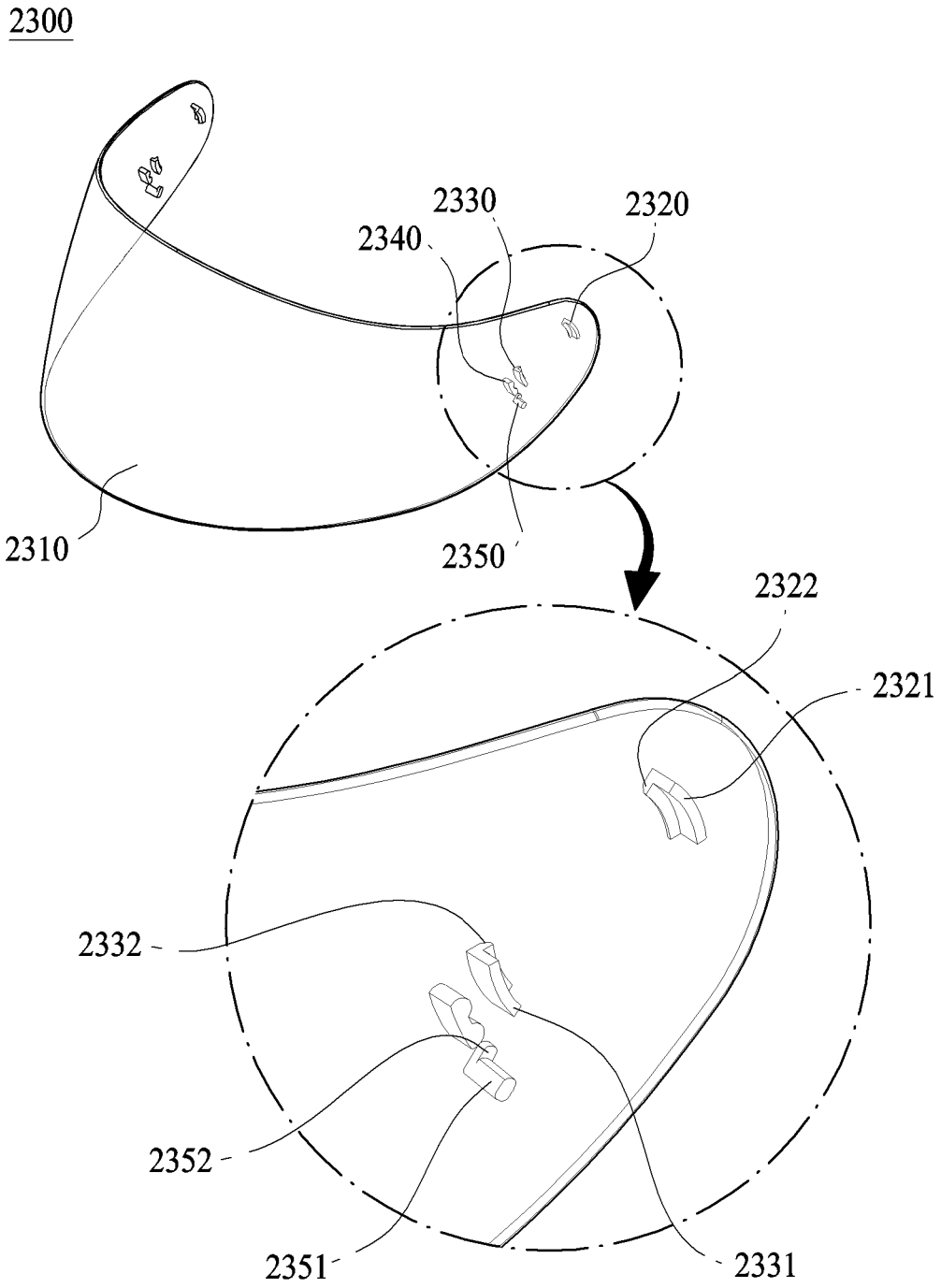
FIG. 5 is a perspective view of a shield portion according to an embodiment of the present invention.

FIG. 5 is a perspective view of a shield portion according to an embodiment of the present invention.

Referring to FIG. 5, the shield portion 2300 may include a shield body portion 2310 and a first protrusion 2320 that protrudes inward from the shield body portion 2310 seated on the jaw protection seating portion 2120.

In addition, the shield portion 2300 may further include a second protrusion 2330 protruding inward from the shield body portion 2310 seated on the jaw protection seating portion 2120.

In addition, the shield portion 2300 may further include a third protrusion 2340 and a fourth protrusion 2350 protruding inward from the shield body portion 2310.

The shield body portion 2310 may be connected to the jaw protection portion 2100 to protect part of the face part including the eyes and nose of the wearer.

Accordingly, when the wearer wears the helmet, a certain area may be provided so that the wearer's face part can be protected.

The first protrusion 2320 may include a $(1\text{-}1)^{th}$ protrusion 2321 connected to the shield body portion 2310 and a $(1\text{-}2)^{th}$ protrusion 2322 connected to the $(1\text{-}1)^{th}$ protrusion 2321.

The $(1\text{-}2)^{th}$ protrusion 2322 may have a larger width than the $(1\text{-}1)^{th}$ protrusion 2321.

In an example, the $(1\text{-}2)^{th}$ protrusion 2322 may protrude toward one side of the $(1\text{-}1)^{th}$ protrusion 2321.

However, the present invention is not limited thereto, and the relative arrangement of the $(1\text{-}1)^{th}$ protrusion 2321 and the $(1\text{-}2)^{th}$ protrusion 2322 may be variously modified at a level that is obvious to those skilled in the art.

The second protrusion 2330 may include a $(2\text{-}1)^{th}$ protrusion 2331 connected to the shield body portion 2310 and a $(2\text{-}2)^{th}$ protrusion 2332 connected to the $(2\text{-}1)^{th}$ protrusion 2331.

The $(2\text{-}2)^{th}$ protrusion 2332 may have a larger width than the $(2\text{-}1)^{th}$ protrusion 2331.

In an example, the $(2\text{-}2)^{th}$ protrusion 2332 may protrude toward one side of the $(2\text{-}1)^{th}$ protrusion 2331.

In an example, the $(1\text{-}2)^{th}$ protrusion 2322 and the $(2\text{-}2)^{th}$ protrusion 2332 may face each other.

However, the present invention is not limited thereto, and the relative arrangement of the $(1\text{-}1)^{th}$ protrusion 2321 and the $(1\text{-}2)^{th}$ protrusion 2322 may be variously modified at a level that is obvious to those skilled in the art.

One side of the third protrusion 2340 may form a plurality of curved surfaces.

A side surface of the third protrusion 2340 in the direction of the second protrusion 2330 may form a plurality of curved surfaces.

The fourth protrusion 2350 may include a $(4\text{-}1)^{th}$ protrusion 2351 connected to the shield body portion 2310 and a $(4\text{-}2)^{th}$ protrusion 2352 connected to the $(4\text{-}1)^{th}$ protrusion 2351.

The $(4\text{-}2)^{th}$ protrusion 2352 may have a larger width than the $(4\text{-}1)^{th}$ protrusion 2351.

In an example, the $(4\text{-}2)^{th}$ protrusion 2352 may be formed to protrude toward one side of the $(4\text{-}1)^{th}$ protrusion 2351.

Figure 6:
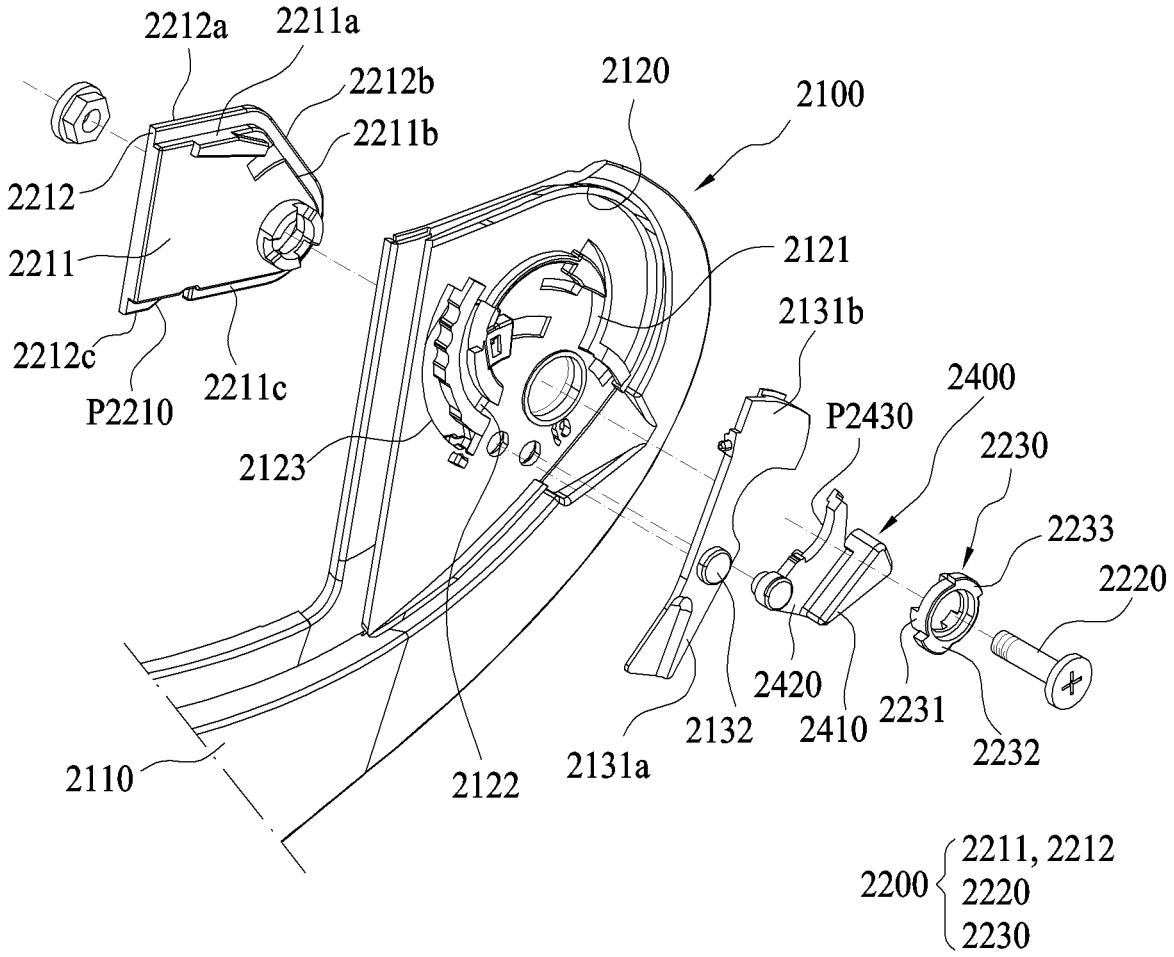
FIG. 6 is an exploded perspective view of a jaw mediation portion connected to a jaw protection portion according to an embodiment of the present invention.
Figure 7A:
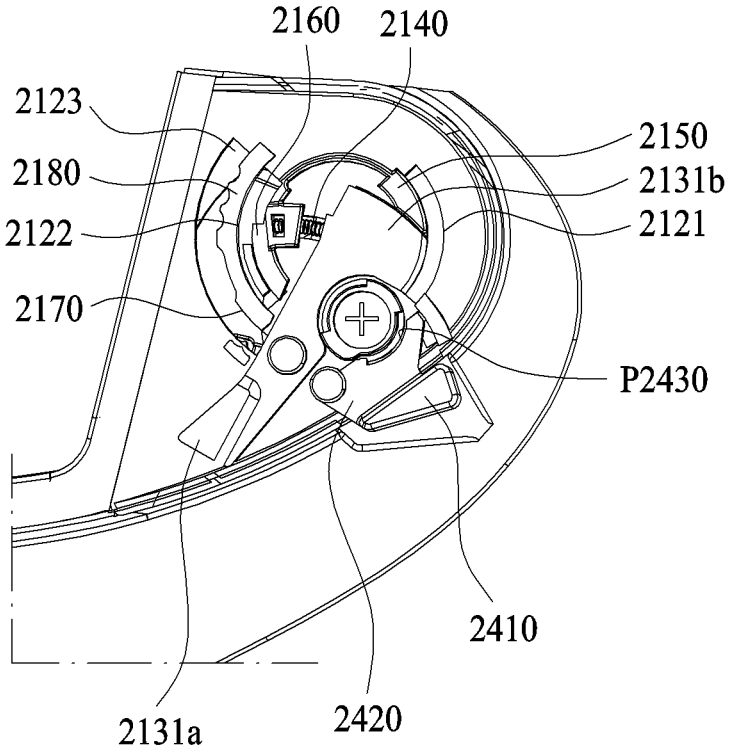
FIGS. 7A and 7B are enlarged views of a jaw protection seating portion provided by the jaw protection portion according to an embodiment of the present invention.
Figure 7B:
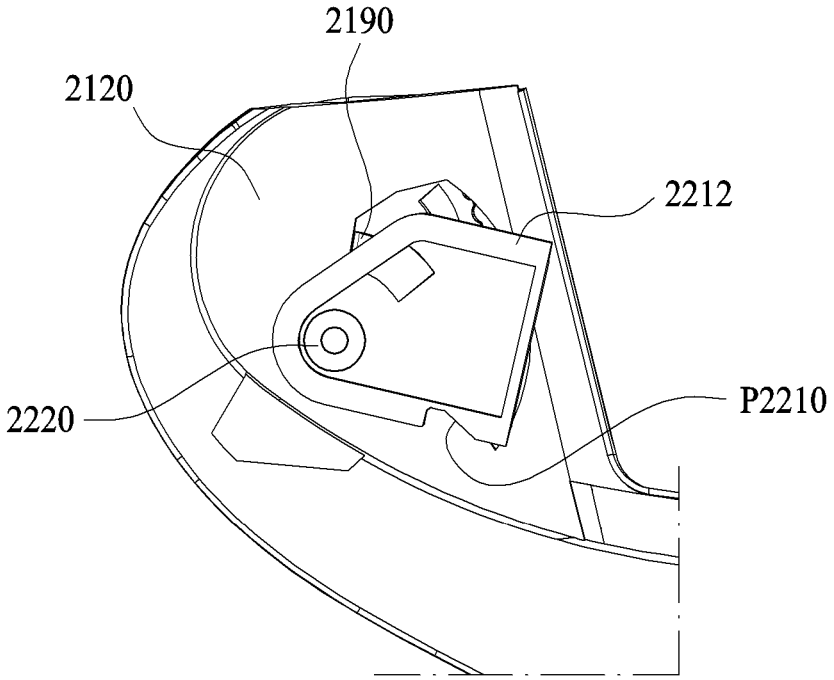

FIG. 6 is an exploded perspective view of a jaw mediation portion connected to a jaw protection portion according to an embodiment of the present invention, and FIGS. 7A and 7B are enlarged views of a jaw protection seating portion provided by the jaw protection portion according to an embodiment of the present invention.

Specifically, FIG. 7A is a view showing the outer surface of the jaw protection seating portion, and FIG. 7B is a view showing the inner surface of the jaw protection seating portion.

Referring to FIGS. 6, 7A and 7B, the jaw mediation portion 2200 may include jaw mediation body portions 2211 and 2212, a shaft portion 2220 that connects the jaw mediation body portions 2211 and 2212 to the jaw protection portion 2100 so that the jaw mediation body portions 2211 and 2212 may be rotated based on the jaw protection portion 2100, and a mediation limiting portion 2230 connected to the shaft portion 2220.

Here, part of the side surface of the jaw mediation portion 2200 may be recessed and thus, a locking recess portion P2210 may be formed so that, when the front cover 2000 for helmets is connected to the shell 1000 for a helmet, the front cover 2000 for helmets may be prevented from being separated from the shell 1000 for a helmet.

The shaft portion 2220 may be inserted into a hole formed in the jaw protection seating portion 2120 to be described later and fixed to the jaw protection seating portion 2120.

The jaw mediation body portions 2211 and 2212 may be in contact with the inner surface of the jaw protection seating portion 2120 so as to be rotatably connected to the shaft portion 2220.

The mediation limiting portion 2230 may be in contact with the outer surface of the jaw protection seating portion 2120 so as to be rotatably connected to the shaft portion 2220.

The jaw mediation body portions 2211 and 2212 may include a first jaw mediation body portion 2211 positioned adjacent to the jaw protection seating portion 2120 and a second jaw mediation body portion 2212 connected to the first jaw mediation body portion 2211.

In an example, the top surface of the second jaw mediation body portion 2212 may be connected to the bottom surface of the first jaw mediation body portion 2211.

In an example, since the bottom surface of the first jaw mediation body portion 2211 is smaller than the top surface of the second jaw mediation body portion 2212, the bottom surface of the first jaw mediation body portion 2211 may be included in the top surface of the second jaw mediation body portion 2212.

Accordingly, a side surface of the first jaw mediation body portion 2211 and a side surface of the second jaw mediation body portion 2212 may form multiple stages with each other.

The first jaw mediation body portion 2211 may include a $(1\text{-}1)^{th}$ outer surface 2211*a*, a $(1\text{-}2)^{th}$ outer surface 2211*b* connected to the $(1\text{-}1)^{th}$ outer surface 2211*a* at a certain angle, and a $(1\text{-}3)^{th}$ outer surface 2211*c* having a certain angle with the $(1\text{-}2)^{th}$ outer surface 2211*b*.

In an example, the $(1\text{-}1)^{th}$ outer surface 2211*a* and the $(1\text{-}3)^{th}$ outer surface 2211*c* may be parallel to each other.

However, the present invention is not limited thereto, and the relative arrangement of the $(1\text{-}1)^{th}$ outer surface 2211*a* and the $(1\text{-}3)^{th}$ outer surface 2211*c* may be variously modified at a level that is obvious to those skilled in the art.

A portion at which the $(1\text{-}2)^{th}$ outer surface 2211*b* is connected to the (1-3)th outer surface 2211*c* may be formed to be round.

The length of the $(1\text{-}3)^{th}$ outer surface 2211*c* may be longer than the length of the $(1\text{-}1)^{th}$ outer surface 2211*a*.

Accordingly, the $(1\text{-}2)^{th}$ outer surface 2211*b* may be inclined.

The locking recess portion P2210 may be formed in the second jaw mediation body portion 2212.

The second jaw mediation body portion 2212 may include a $(2\text{-}1)^{th}$ outer surface 2212*a*, a $(2\text{-}2)^{th}$ outer surface 2212*b* connected to the $(2\text{-}1)^{th}$ outer surface 2212*a* at a certain angle, and a $(2\text{-}3)^{th}$ outer surface 2212*c* having a certain angle with the $(2\text{-}2)^{th}$ outer surface 2212*b*.

In an example, the $(2\text{-}1)^{th}$ outer surface 2212*a* and the $(2\text{-}3)^{th}$ outer surface 2212*c* may be parallel to each other.

However, the present invention is not limited thereto, and the relative arrangement of the $(2\text{-}1)^{th}$ outer surface 2212*a* and the $(2\text{-}3)^{th}$ outer surface 2212*c* may be variously modified at a level that is obvious to those skilled in the art.

A portion at which the $(2\text{-}2)^{th}$ outer surface 2212*b* and the $(2\text{-}3)^{th}$ outer surface 2212*c* are connected may be formed to be round.

The length of the $(2\text{-}3)^{th}$ outer surface 2212*c* may be greater than the length of the $(2\text{-}1)^{th}$ outer surface 2212*a*.

As a result, the $(2\text{-}2)^{th}$ outer surface 2212*b* may be inclined.

Part of the $(2\text{-}3)^{th}$ outer surface 2212*c* may be recessed so that the shell locking protrusion 1320 can be inserted.

The jaw protection portion 2100 may include a jaw protection body portion 2110 that protects the wearer's jaw when the front cover 2000 for helmets is connected to the shell 1000 for a helmet, a jaw protection seating portion 2120 that is connected to at least one end of the jaw protection body portion 2110 and provides a certain area in which the shield portion 2300 may be seated, and a coupling portion 2130 that determines whether to connect the shield portion 2300 and the jaw protection seating portion 2120 through position movement.

In addition, the jaw protection portion 2100 may further include a jaw elastic portion 2140 that provides an elastic force to the coupling portion 2130 so that the coupling portion 2130 can be held in a locked position when no external force is applied to the coupling portion 2130.

The jaw protection body portion 2110 may have a shape having a curvature so as to protect the jaw of the wearer.

The jaw protection seating portion 2120 may be connected to both ends of the jaw protection body portion 2110.

In an example, the jaw protection seating portion 2120 may be formed to extend upward from an end of the jaw protection body portion 2110.

In an example, the jaw protection body portion 2110 and the jaw protection seating portion 2120 may be integrally formed, but the present invention is not limited thereto and may be variously modified at a level that is obvious to those skilled in the art.

The jaw protection seating portion 2120 may include a first guide portion 2121 that is recessed to a certain depth so that the first protrusion 2320 can be inserted and moved in position so that the shield portion 2300 can be rotated with respect to the jaw protection seating portion 2120.

Also, the jaw protection seating portion 2120 may include a second guide portion 2122 that is recessed to a certain depth so as to be spaced apart from the first guide portion 2121 so that the second protrusion 2330 can be inserted and moved in position so that the shield portion 2300 can be rotated with respect to the jaw protection seating portion 2120.

In addition, the jaw protection seating portion 2120 may include a third guide portion 2123 that is recessed to a certain depth so as to be spaced apart from the first guide portion 2121 and the second guide portion 2122 so that the third protrusion 2340 and the fourth protrusion 2350 can be inserted and moved in position so that the shield portion 2300 can be rotated with respect to the jaw protection seating portion 2120.

The jaw protection portion 2100 may further include a first movement limiting portion 2150 that protrudes from the jaw protection seating portion 2120 and is positioned above the first guide portion 2121 so that, when the first protrusion 2320 is inserted into the first guide portion 2121, the first protrusion 2320 may be prevented from deviating from the first guide portion 2121.

The first movement limiting portion 2150 may protrude from the jaw protection seating portion 2120 around the first guide portion 2121 and may be disposed on part of the upper side of the first guide portion 2121.

Since the $(1\text{-}2)^{th}$ protrusion 2322 is caught on the first movement limiting portion 2150, the first protrusion 2320 may not be separated from the first guide portion 2121.

The jaw protection portion 2100 may further include a second movement limiting portion 2160 that protrudes from the jaw protection seating portion 2120 and disposed above the second guide portion 2122 so that, when the second protrusion 2330 is inserted into the second guide portion 2122, the second protrusion 2330 may be prevented from deviating from the second guide portion 2122.

The second movement limiting portion 2160 may protrude from the jaw protection seating portion 2120 around the second guide portion 2122 and may be disposed on part of the upper side of the second guide portion 2122.

Since the $(2\text{-}2)^{th}$ protrusion 2332 is caught on the second movement limiting portion 2160, the second protrusion 2330 may not be separated from the second guide portion 2122.

However, the second movement limiting portion 2160 may be positioned on only part of the upper side of the second guide portion 2122 corresponding to a partial length of the entire length of the second guide portion 2122.

This may be for implementing a mechanism for attaching and detaching the shield portion 2300 to be described later.

The jaw protection portion 2100 may further include a third movement limiting portion 2170 that protrudes from the jaw protection seating portion 2120 and is disposed above the third guide portion 2123 so that, when the fourth protrusion 2350 is inserted into the third guide portion 2123, the fourth protrusion 2350 may be prevented from deviating from the third guide portion 2123.

The third movement limiting portion 2170 may protrude from the jaw protection seating portion 2120 around the third guide portion 2123 and may be disposed on part of the upper side of the third guide portion 2123.

Since the $(4\text{-}2)^{th}$ protrusion 2352 is caught on the third movement limiting portion 2170, the fourth protrusion 2350 may not be separated from the second guide portion 2122.

However, the third movement limiting portion 2170 may be disposed on only part of the upper side of the third guide portion 2123 corresponding to a partial length of the entire length of the third guide portion 2123.

This may be for implementing a mechanism for attaching and detaching the shield portion 2300 to be described later.

The jaw protection portion 2100 may further include a step adjusting portion 2180 which protrudes from the jaw protection seating portion 2120 and is disposed between the second guide portion 2122 and the third guide portion 2123 and in which the side surface of the direction of the third guide portion 2123 forms a plurality of curved surfaces.

The third movement limiting portion 2170 may be connected to the step adjusting portion 2180.

The side surface of the step adjusting portion 2180 is engaged with the side surface of the third protrusion 2340 so that the shield portion 2300 may move position in a stepwise manner.

The first to third guide portions 2123 may be formed to be round.

Accordingly, the first movement limiting portion 2150 to the third movement limiting portion 2170 and the step adjusting portion 2180 may also be formed to be round.

The mediation limiting portion 2230 includes a first mediation limiting portion 2231 connected to the shaft portion 2220 and a second mediation limiting portion 2232 protruding from the first mediation limiting portion 2231 in one direction.

In addition, the mediation limiting portion 2230 may further include a third mediation limiting portion 2233 protruding from the first mediation limiting portion 2231 in the other direction.

The mediation limiting portion 2230 may be rotated together with respect to the shaft portion 2220 as the jaw mediation body portions 2211 and 2212 are rotated.

The coupling portion 2130 may include coupling body portions 2131*a* and 2131*b*, and a coupling shaft portion 2132 connecting the coupling body portions 2131*a* and 2131*b* and the jaw protection seating portion 2120 to each other.

The coupling body portions 2131*a* and 2131*b* may rotate and reciprocate with respect to the jaw protection seating portion 2120 due to the coupling shaft portion 2132.

The coupling body portions 2131*a* and 2131*b* may include a first coupling body portion 2131*a* disposed on one side of the coupling shaft portion 2132 and a second coupling body portion 2131*b* disposed on the other side based on the coupling shaft portion 2132.

The jaw elastic portion 2140 may be connected to the second coupling body portion 2131*b*.

The jaw elastic portion 2140 may contract according to the positional movement of the second coupling body portion 2131*b*.

In an example, one side of the second coupling body portion 2131*b* may form a uniform side surface with the first movement limiting portion 2150.

In addition, the other side of the second coupling body portion 2131*b* may be connected to the jaw elastic portion 2140.

The jaw elastic portion 2140 may be connected to the second coupling body portion 2131*b* and the jaw protection seating portion 2120.

FIGS. 8A, 8B, 8C, 9A, and 9B are views for explaining a process in which a shield portion 2300 is detached from a jaw protection portion 2100 in a front cover 2000 for helmets according to an embodiment of the present invention.

Figure 8A:
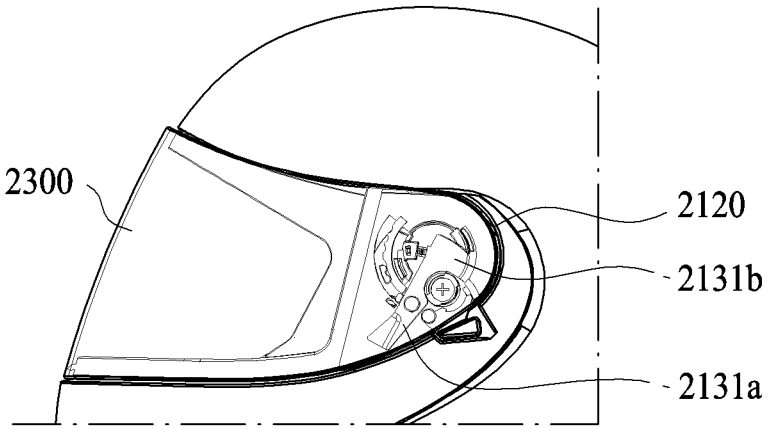
FIGS. 8A, 8B, 8C, 9A, and 9B are views for explaining a process in which the shield portion of the front cover for the helmet is detachably attached to the jaw protection portion according to an embodiment of the present invention.

Referring to FIG. 8A, the shield portion 2300 may be moved in position based on the jaw protection portion 2100.

Among the distances between the front end of the shield portion 2300 and the front end of the jaw protection portion 2100, the position of the shield portion 2300 when the distance between the front end of the shield portion 2300 and the front end of the jaw protection portion 2100 is the closest may be referred to as a closed position of the shield portion 2300.

Conversely, among the distances between the front end of the shield portion 2300 and the front end of the jaw protection portion 2100, the position of the shield portion 2300 when the distance between the front end of the shield portion 2300 and the front end of the jaw protection portion 2100 is the farthest may be referred to as an open position of the shield portion 2300.

When the shield portion 2300 is in a closed position, the coupling body portions 2131*a* and 2131*b* may be concealed from the outside by the shield portion 2300.

When the shield portion 2300 is in the closed position, the wearer may not be able to manipulate the first coupling body portion 2131*a*.

When the shield portion 2300 is connected to the jaw protection seating portion 2120, the shield portion 2300 may be rotated based on the jaw protection seating portion 2120.

When the shield portion 2300 is located in an open position, the coupling portion 2130 may be partially concealed by the shield portion 2300 and connected to the jaw protection seating portion 2120 so that the remaining part is exposed to the outside.

Figure 8B:
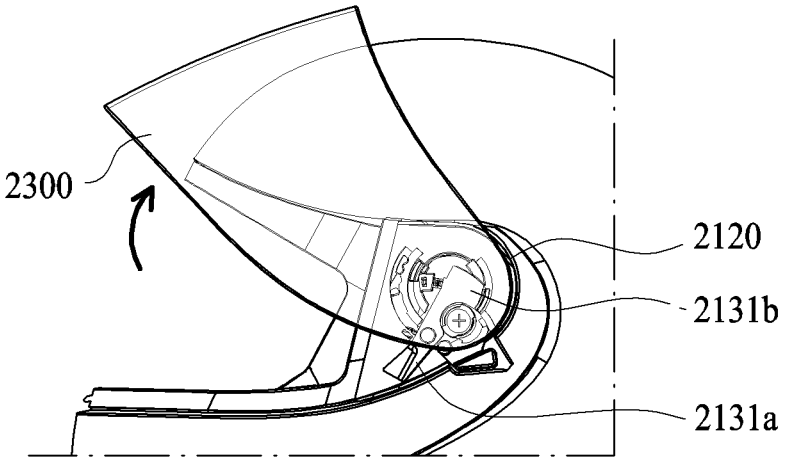

Referring to FIG. 8B, when the shield portion 2300 is moved from the closed position to the open position, the first coupling body portion 2131*a* is exposed to the outside at an arbitrary position between the closed position and the open position of the shield portion 2300.

Figure 8C:
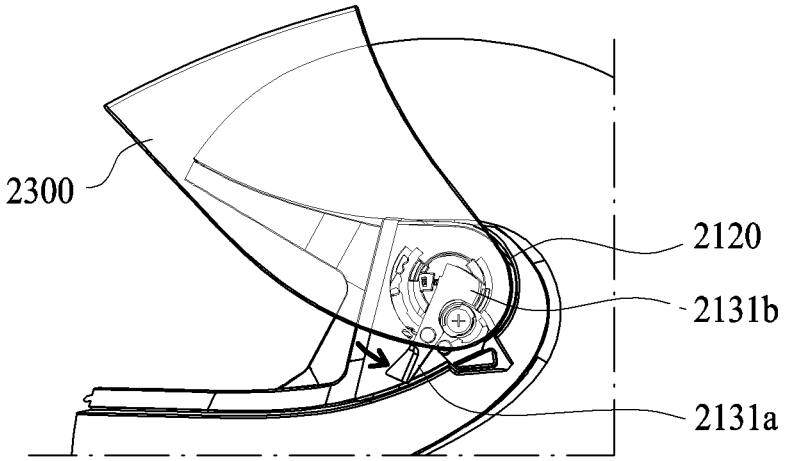

However, referring to FIG. 8C, the case where the first coupling body portion 2131*a* is exposed to the outside most often may be a case where the shield portion 2300 is in the open position.

Therefore, it may be desirable for the wearer to position the shield portion 2300 to an open position in order to apply an external force to the first coupling body portion 2131*a*.

Figure 9A:
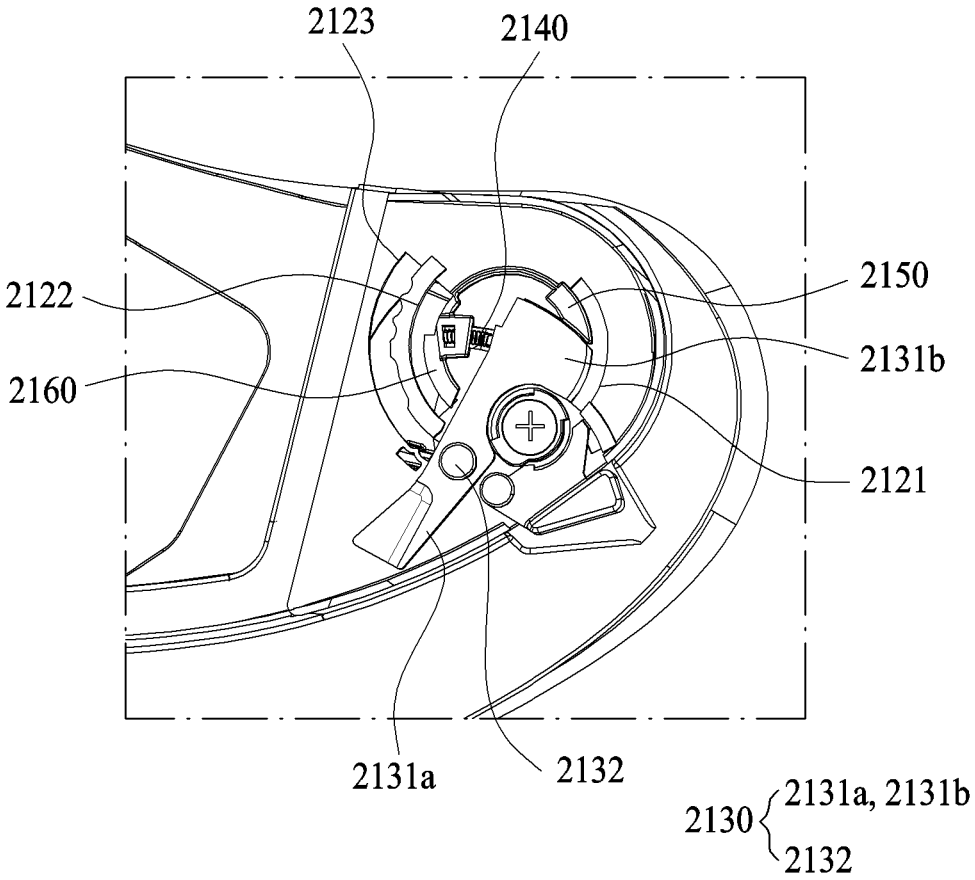
Figure 9B:
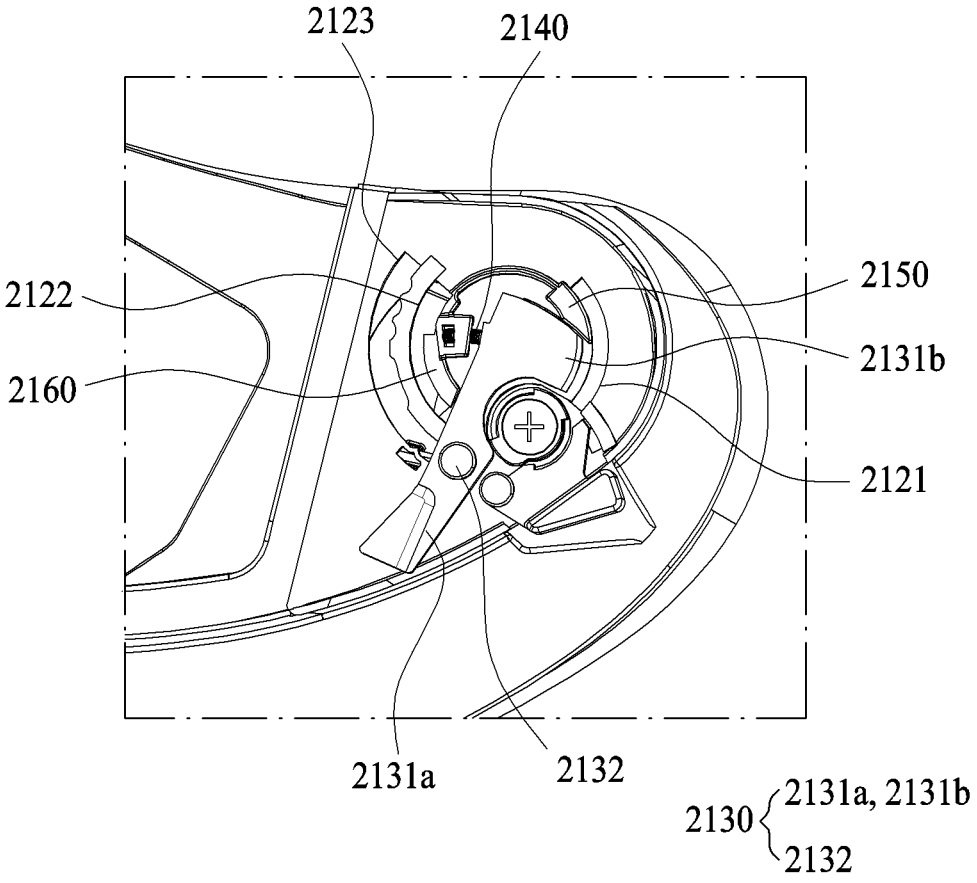

FIG. 9A is a view showing when the coupling portion 2130 is in a locked position, and FIG. 9B is a view showing when the coupling portion 2130 is in a released position.

When the coupling portion 2130 is in the locked position, the coupling portion 2130 may limit the positional movement of the shield portion 2300 so that the shield portion 2300 connected to the jaw protection seating portion 2120 is not separated from the jaw protection seating portion 2120.

When the coupling portion 2130 is in the released position, the coupling portion 2130 may not be able to limit the positional movement of the shield portion 2300 so that the shield portion 2300 connected to the jaw protection seating portion 2120 can be separated from the jaw protection seating portion 2120.

Referring to FIGS. 4, 7A and 9A, when the coupling portion 2130 is in the locked position, the second coupling body portion 2131*b* may form a uniform side with the first movement limiting portion 2150.

That is, when the coupling portion 2130 is in the locked position, part of the second coupling body portion 2131*b* may be located above the first guide portion 2121.

Accordingly, when the coupling portion 2130 is in the locked position, when the first protrusion 2320 is positioned on the first guide portion 2121, the $(1\text{-}2)^{th}$ protrusion 2322 is caught in the second coupling body portion 2131*b* and the first movement limiting portion 2150 so that the first protrusion 2320 may not be separated from the first guide portion 2121.

In addition, when the coupling portion 2130 is in the locked position, the first protrusion 2320 may not be inserted into the first guide portion 2121.

When no external force is applied to the first coupling body portion 2131*a*, the coupling portion 2130 may maintain the locked position.

When the coupling portion 2130 is in the locked position, part of the coupling portion 2130 is disposed above the first guide portion 2121, and the coupling portion 2130 may prevent the first protrusion 2320 inserted into the first guide portion 2121 from deviating from the first guide portion 2121.

In order to connect the shield portion 2300 to the jaw protection seating portion 2120, the first protrusion 2320 may be inserted into the first guide portion 2121.

Alternatively, the shield portion 2300 may need to separate the first protrusion 2320 from the first guide portion 2121 in order to separate it from the jaw protection seating portion 2120.

To this end, referring to FIGS. 4, 7A, and 9B, in order to move the coupling portion 2130 from the locked position to the released position, the wearer can apply an external force to the first coupling body portion 2131*a*.

When the external force is applied to the first coupling body portion 2131*a*, the first coupling body portion 2131*a* and the second coupling body portion 2131*b* may be rotated based on the coupling shaft portion 2132.

Accordingly, the jaw elastic portion 2140 may contract to store elastic energy.

When the coupling portion 2130 is in the released position, the second coupling body portion 2131*b* may not form a uniform side surface with the first movement limiting portion 2150.

When the coupling portion 2130 is in the locked position, part of the second coupling body portion 2131*b* may not be located above the first guide portion 2121.

Accordingly, when the coupling portion 2130 is in the released position, and when the first protrusion 2320 is positioned on the first guide portion 2121, the $(1\text{-}2)^{th}$ protrusion 2322 is not caught in the second coupling body portion 2131*b* so that the first protrusion 2320 may not be separated from the first guide portion 2121.

In addition, when the coupling portion 2130 is in the released position, the first protrusion 2320 may be inserted into the first guide portion 2121.

When an external force is removed from the first coupling body portion 2131*a*, the coupling portion 2130 may be moved to a locked position by the jaw elastic portion 2140.

When the coupling portion 2130 is in the released position, all parts of the coupling portion 2130 are not disposed above the first guide portion 2121 so that the first protrusion 2320 inserted into the first guide portion 2121 may be separated from the first guide portion 2121.

Hereinafter, the process of attaching and detaching the shield portion 2300 will be described in detail.

When the shield portion 2300 is in the open position, the second protrusion 2330 may be separated from the upper side of the second guide portion 2122.

When the shield portion 2300 is in the protected position, the second protrusion 2330 may be located at a position corresponding to the second movement limiting portion 2160.

In order to separate the shield portion 2300 from the jaw protection seating portion 2120, the wearer may move the shield portion 2300 to an open position.

The $(1\text{-}2)^{th}$ protrusion 2322 may be located at a position corresponding to the second coupling body portion 2131*b*.

In addition, the $(2\text{-}2)^{th}$ protrusion 2332 may be located on the second guide portion 2122 in which the second movement limiting portion 2160 is not disposed among the second guide portions 2122.

In addition, the $(4\text{-}2)^{th}$ protrusion 2352 may be located on the third guide portion 2123 in which the third movement limiting portion 2170 is not disposed among the third guide portions 2123.

Accordingly, when the shield portion 2300 is in the open position, the (1-2)$^{th}$ protrusion 2322 is caught by the second coupling body portion 2131*b* so that the shield portion 2300 may not be separated from the jaw protection portion 2100.

Conversely, when the shield portion 2300 is not in the open position, the (1-2)$^{th}$ protrusion 2322 is caught by the second coupling body portion 2131*b* and the first movement limiting portion 2150 so that the shield portion 2300 may not be separated from the jaw protection portion 2100.

In addition, when the shield portion 2300 is not in the open position, the (2-2)$^{th}$ protrusion 2332 is caught by the second movement limiting portion 2160 so that the shield portion 2300 may not be separated from the jaw protection portion 2100.

In addition, when the shield portion 2300 is not in the open position, the (4-2)$^{th}$ protrusion 2352 is caught by the third movement limiting portion 2170 so that the shield portion 2300 may not be separated from the jaw protection portion 2100.

Due to the wearer applying an external force to the first coupling body portion 2131*a*, the coupling portion 2130 may be moved from the locked position to the released position.

After that, the (1-2)$^{th}$ protrusion 2322 may be separated from the first guide portion 2121, and the shield portion 2300 may be separated from the jaw protection portion 2100.

The process of connecting the jaw protection portion 2100 of the shield portion 2300 may be performed in reverse of the above-described separation process, and a detailed description thereof may be omitted.

Hereinafter, a process in which the front cover 2000 for helmets is detachably attached to the shell 1000 for a helmet will be described in detail.

Figure 10A:
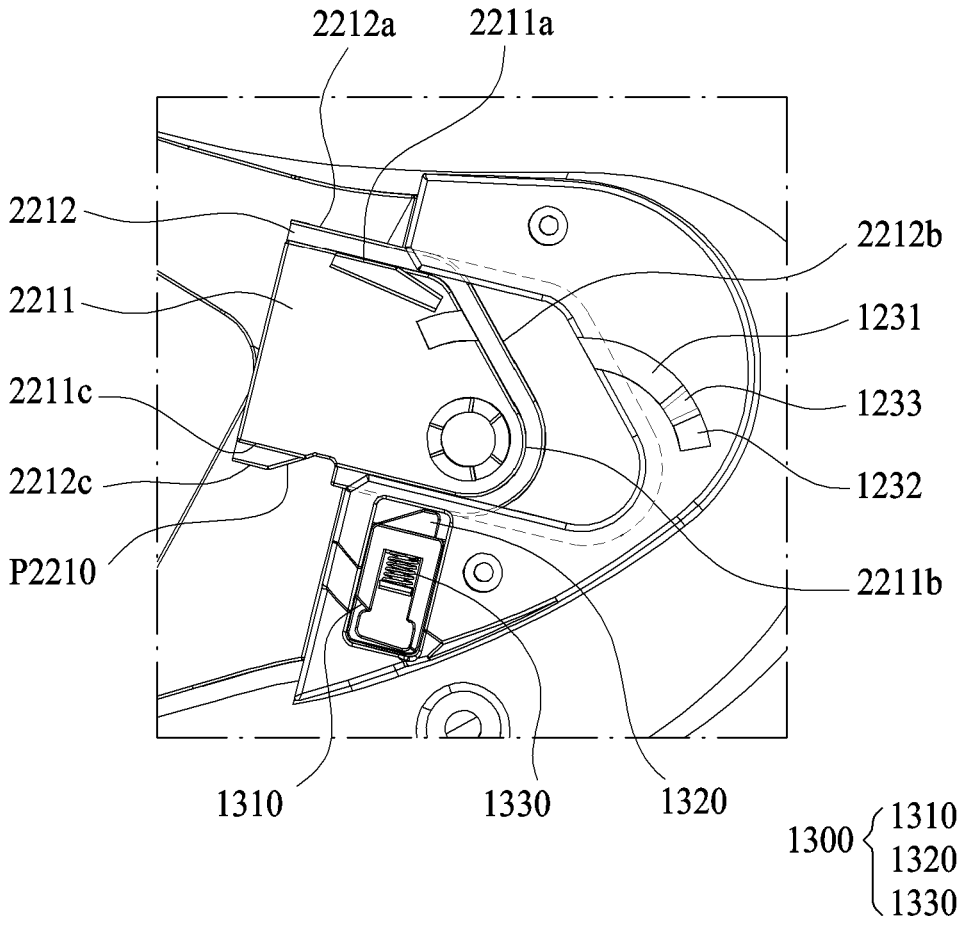
FIGS. 10A and 10B are views for explaining a process in which the front cover for the helmet is detachably attached to the shell for the helmet according to an embodiment of the present invention.
Figure 10B:
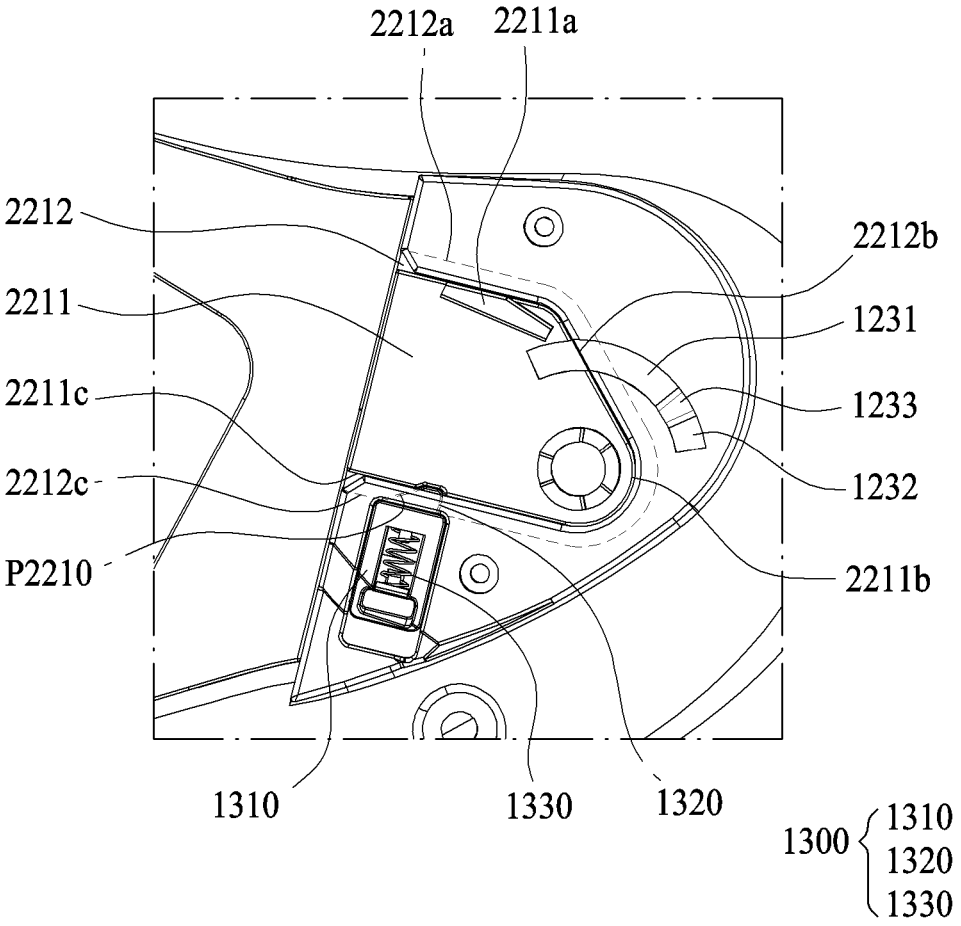

FIGS. 10A and 10B are views for explaining a process in which the front cover 2000 for helmets is detachably attached to the shell 1000 for a helmet according to an embodiment of the present invention.

Referring to FIG. 10A, the jaw mediation body portions 2211 and 2212 are inserted into the inner space of the first shell mediation portion 1210 and the second shell mediation portion 1220, and the front cover 2000 for helmets can be coupled to the shell 1000 for a helmet.

As a specific example, while the jaw mediation body portions 2211 and 2212 slide on the inner surface of the shell mediation portion 1200, the jaw mediation body portions 2211 and 2212 may be fastened to the shell mediation portion 1200.

The (1-1)$^{th}$ inner surface 1211 of the first shell mediation portion 1210 may be in contact with the (2-1)$^{th}$ outer surface 2212*a* of the second jaw mediation body portion 2212 to be allowed to slip.

In addition, the (2-1)$^{th}$ inner surface 1221 of the second shell mediation portion 1220 may be in contact with the (1-1)$^{th}$ outer surface 2211*a* of the first jaw mediation body portion 2211 to be allowed to slip.

In addition, the (1-3)$^{th}$ inner surface 1213 of the first shell mediation portion 1210 may be in contact with the (2-3)$^{th}$ outer surface 2212*c* of the second jaw mediation portion 2200 to be allowed to slip.

In addition, the (2-3)$^{th}$ inner surface 1223 of the second shell mediation portion 1220 may be in contact with the (1-3)$^{th}$ outer surface 2211*c* of the first jaw mediation body portion 2211 to be allowed to slip.

The (2-3)$^{th}$ outer surface 2212*c* of the second jaw mediation body portion 2212 may contact the second locking surface 1322, and the (2-3)$^{th}$ outer surface 2212*c* of the second jaw mediation body portion 2212 and the (1-3)$^{th}$ inner surface 1213 of the first shell mediation portion 1210 contact each other, and thus the shell locking portion 1300 may be moved from the protruding position to the spaced position.

Here, the shell elastic portion 1330 may contract to store elastic energy.

When the shell locking portion 1300 is in a protruding position, the shell locking portion 1300 may be inserted into the locking recess portion P2210 formed by being recessed into the jaw mediation portion 2200.

When the shell locking portion 1300 is in a spaced position, the shell locking portion 1300 may be spaced apart from the locking recess portion P2210.

Referring to FIG. 10B, when the (1-2)$^{th}$ inner surface 1212 of the first shell mediation portion 1210 is in contact with the (2-2)$^{th}$ outer surface 2212*b* of the second jaw mediation body portion 2211 and the (2-2)$^{th}$ inner surface 1222 of the second shell mediation portion 1220 is in contact with the (1-2)$^{th}$ outer surface 2211*b* of the first jaw mediation body portion 2211, the locking recess portion P2210 may be located at a position corresponding to the shell locking protrusion 1320.

At this time, the shell locking body portion 1310 may be raised by the elastic force of the shell elastic portion 1330, and thus the shell locking protrusion 1320 may be inserted into the locking recess portion P2210.

The position of the shell locking portion 1300 at this time may be referred to as a limit position.

As the shell locking protrusion 1320 is inserted into the locking recess portion P2210, the jaw mediation body portions 2211 and 2212 may not be separated from the shell mediation portion 1200.

Conversely, a method of separating the front cover 2000 for helmets coupled to the shell 1000 for a helmet may be performed in the opposite manner to the above-described method.

As a specific example, an external force is applied to the shell locking body portion 1310 in a downward direction, and the shell locking protrusion 1320 may be withdrawn from the locking recess portion P2210.

At this time, the shell elastic portion 1330 may contract.

Here, the jaw mediation body portions 2211 and 2212 may be drawn out in a direction opposite to the direction of insertion into the shell mediation portion 1200 to be separated from the shell mediation portion 1200.

FIGS. 11A, 11B, 11C, 12A, 12B, and 12C are views for explaining a change in the position of the front cover 2000 for helmets based on the shell 1000 for a helmet according to an embodiment of the present invention.

Figure 11A:
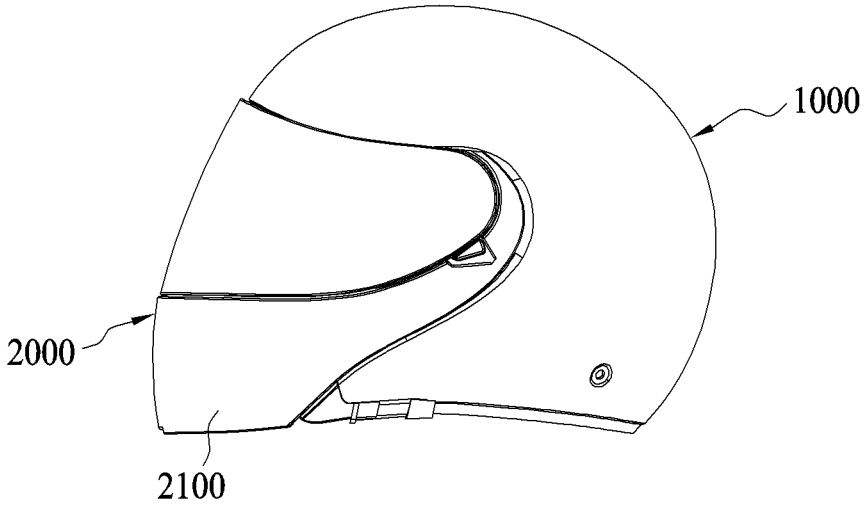
FIGS. 11A, 11B, 11C, 12A, 12B and 12C are views for explaining changes in the position on the basis of the shell for the helmet of the front cover for the helmet according to an embodiment of the present invention.
Figure 11B:
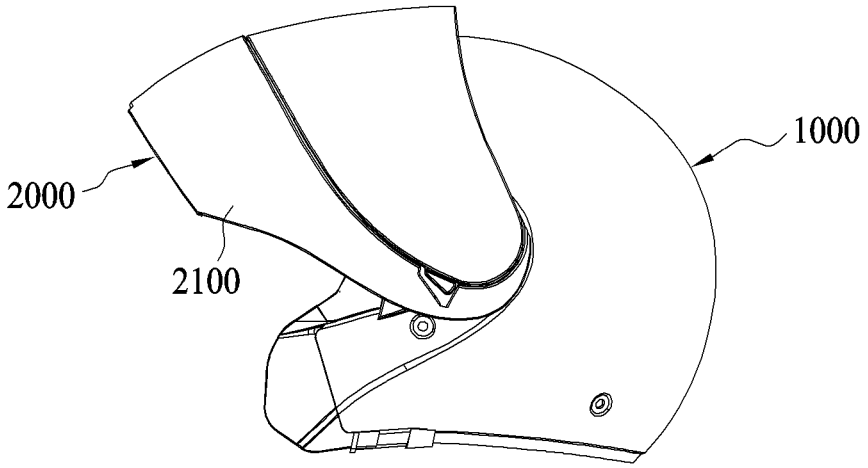
Figure 11C:
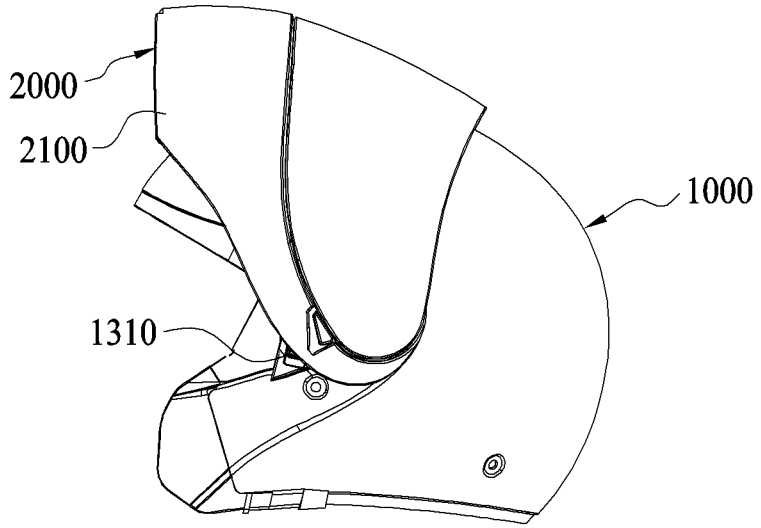
Figure 12A:
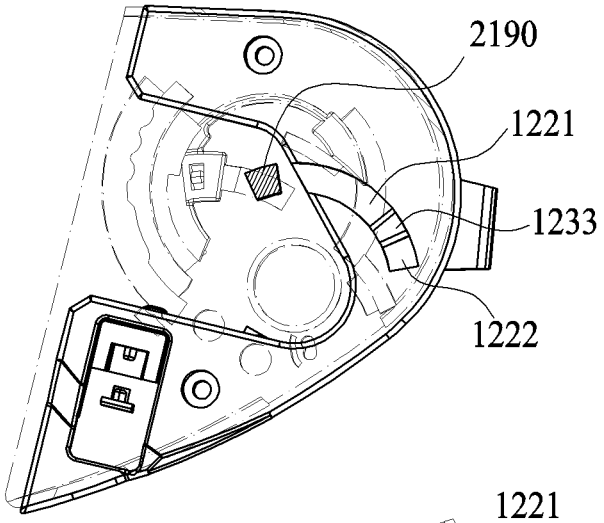
Figure 12B:
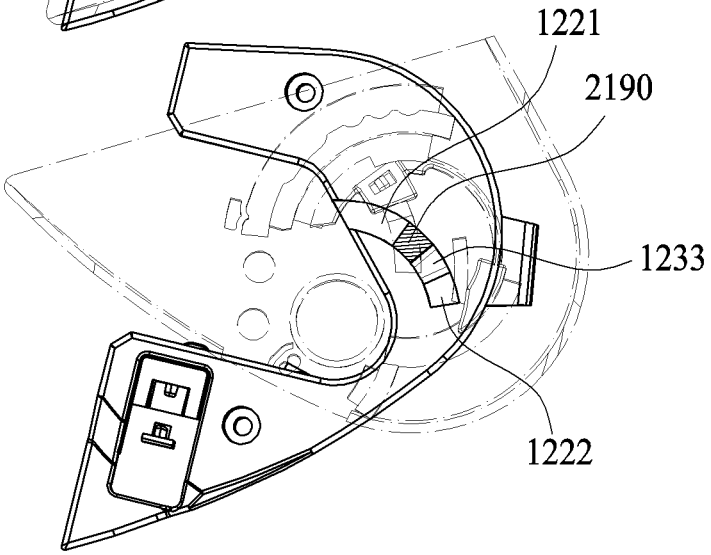
Figure 12C:
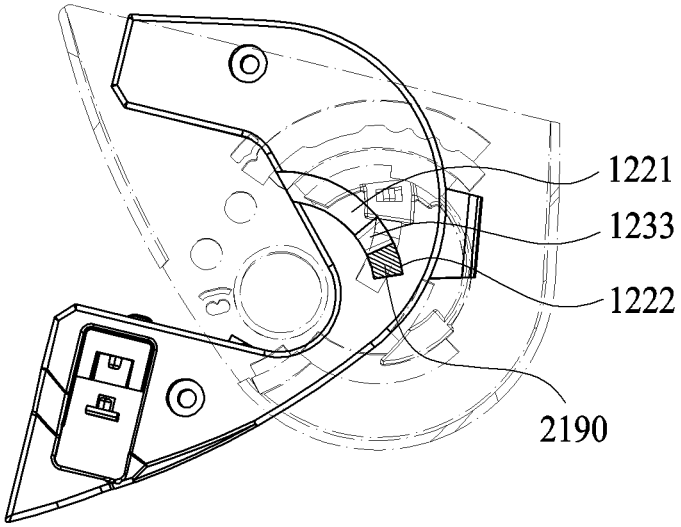

Specifically, FIGS. 11A and 12A are views showing when the front cover 2000 for helmets is in a lowered position, FIGS. 11B and 12B are views showing when the front cover 2000 for helmets is in an intermediate position, and FIGS. 11C and 12C are views showing when the front cover 2000 for helmets is in a raised position.

When the front cover 2000 for helmets is connected to the shell 1000 for a helmet, the front cover 2000 for helmets may be rotated based on the shell 1000 for a helmet.

When the front cover 2000 for helmets is connected to the shell 1000 for a helmet by the jaw mediation portion 2200, the jaw protection portion 2100 may be rotatable based on the shell 1000 for a helmet.

The jaw mediation portion 2200 may be rotatably connected to the jaw protection portion 2100.

The jaw mediation portion 2200 may be connected to at least one of both ends of the jaw protection portion 2100 so that the jaw mediation portion 2200 protrudes from the inner surface of the end of the jaw protection portion 2100.

Here, it may be preferable that the jaw mediation portion 2200 is connected to both ends of the jaw protection portion 2100.

However, the present invention is not limited thereto.

Referring to FIGS. 11A and 12A, when the front cover 2000 for helmets is in a lowered position, the front cover 2000 for helmets may be positioned at the lowest of the positions at which the front cover 2000 for helmets can be located based on the shell 1000 for a helmet.

The jaw protection portion 2100 may further include a jaw protection protrusion 2190 protruding from the inner surface of the jaw protection seating portion 2120.

When the front cover 2000 for helmets is in the lowered position, the jaw protection protrusion 2190 may not be inserted into the shell guide portions 1221 and 1222.

Referring to FIGS. 11B and 12B, when the front cover 2000 for helmets is in an intermediate position, the jaw protection protrusion 2190 may be inserted into the first shell guide portion 1231.

Here, the jaw protection protrusion 2190 may come into contact with the shell protrusion 1233.

When the front cover 2000 for helmets is in an intermediate position, the position of the front cover 2000 for helmets may not be fixed.

In an example, the user may apply an external force to the front cover 2000 for helmets to move the front cover 2000 for helmets from a lowered position to an intermediate position.

Here, when the user removes the external force applied to the front cover 2000 for helmets, the front cover 2000 for helmets, which is at an intermediate position, may be moved to the lowered position.

Referring to FIGS. 11C and 12C, when the front cover 2000 for helmets, which is at an intermediate position, is continuously moved upward, the jaw protection protrusion 2190 slips and passes the shell protrusion 1233 and may be inserted into the second shell guide portion 1222.

That is, when the front cover 2000 for helmets is in the raised position, the jaw protection protrusion 2190 may be inserted into the second shell guide portion 1222.

When the front cover 2000 for helmets is in the raised position, the shell protrusion 1233 restricts the positional movement of the jaw protection protrusion 2190 so that the position of the front cover 2000 for helmets may be fixed.

However, when an external force greater than a predetermined standard is applied to lower the front cover 2000 for helmets in the raised position, the jaw protection protrusion 2190 slips and passes the shell protrusion 1233 and may move to the first shell guide portion 1231.

When the front cover 2000 for helmets is in the raised position, part of the shell locking body portion 1310 may be exposed to the outside.

In contrast, when the front cover 2000 for helmets is in a lowered position and/or an intermediate position, the shell locking body portion 1310 is not exposed to the outside and may be concealed by the front cover 2000 for helmets.

Accordingly, in order to separate the front cover 2000 for helmets from the shell 1000 for a helmet, the wearer may perform the separation operation after moving the front cover 2000 for helmets to the raised position.

Figure 13A:
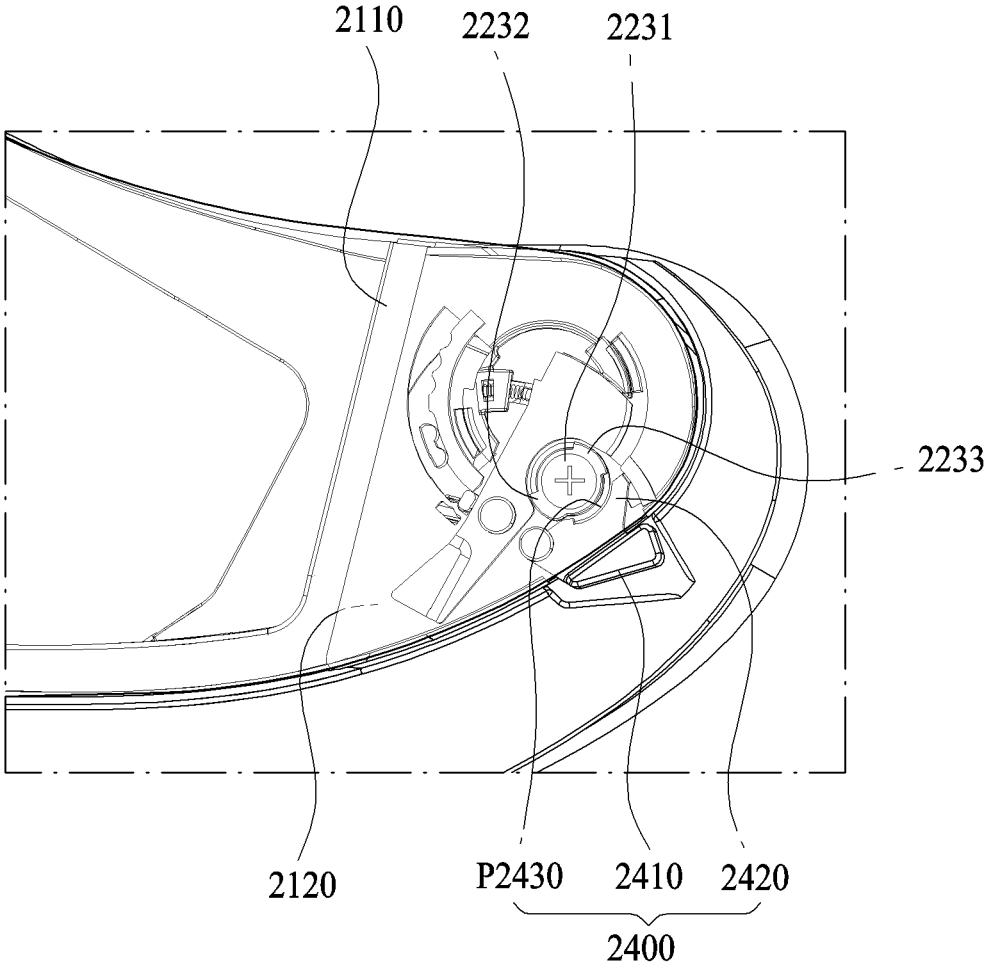
FIGS. 13A, 13B, and 13C are views for explaining a jaw locking portion of the front cover for the helmet according to an embodiment of the present invention.
Figure 13B:
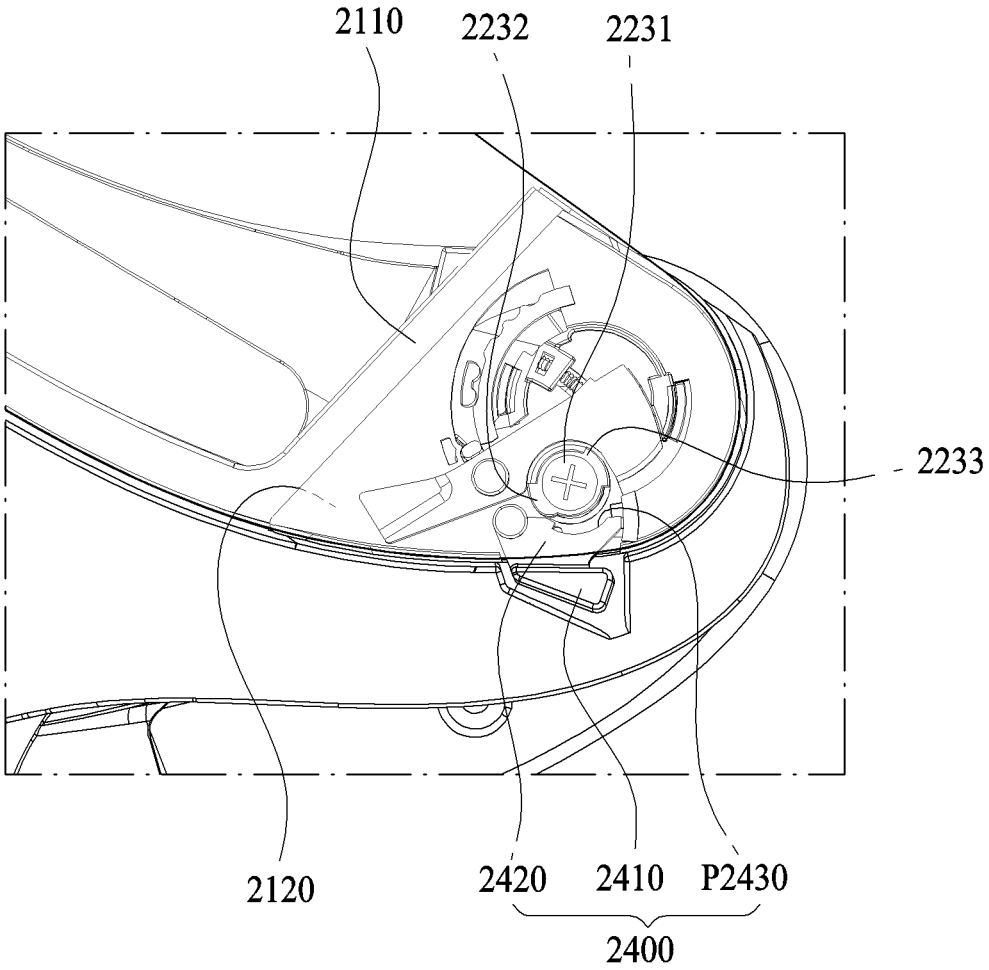

FIGS. 13A and 13B are views for explaining a jaw locking portion 2410 provided in the front cover 2000 for helmets according to an embodiment of the present invention.

Specifically, FIGS. 13A and 13B are views showing a state in which the jaw locking portion 2410 is located in a restricted position when the front cover 2000 for helmets is in a lowered position.

Figure 13C:
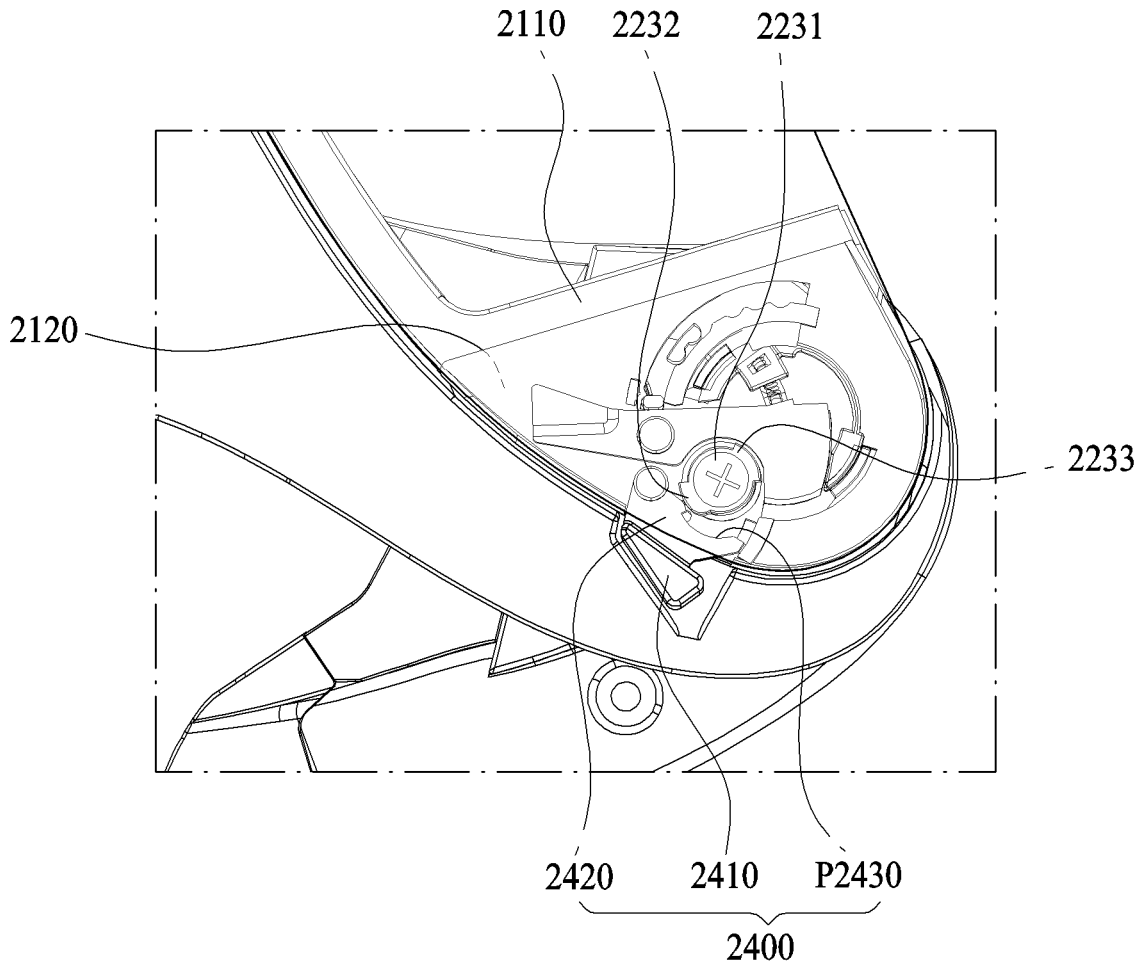

Referring to FIGS. 13A, 13B, and 13C, the front cover 2000 for helmets may further include a jaw locking portion 2400 that is connected to the jaw protection portion 2100, rotates together with the jaw protection portion 2100 and can be moved in position based on the jaw protection portion 2100 when the front cover 2000 for helmets is connected to the shell 1000 for a helmet.

The jaw locking portion 2400 may include a first jaw locking portion 2410 for receiving an external force for positional movement, and a second jaw locking portion 2420 connected to the first jaw locking portion 2410.

The jaw locking portion 2400 may be rotatably connected to the jaw protection body portion 2110 and/or the jaw protection seating portion 2120.

The first jaw locking portion 2410 may be exposed to the outside.

At least a portion of the second jaw locking portion 2420 may be disposed between the shield body portion 2310 and the jaw protection seating portion 2120 to be concealed by the shield body portion 2310.

The second jaw locking portion 2420 may be recessed into a side surface to form a jaw locking recess portion P2430.

The jaw locking portion 2400 may be rotated to a free position or a limited position based on the jaw protection portion (see 2100 of FIG. 4) and may be moved in position.

In an example, when the jaw locking portion 2400 is in a free position, the jaw locking portion 2400 may be located at the lowermost side among positions in which the jaw locking portion 2400 can be located.

For example, when the jaw locking portion 2400 is in the limited position, the jaw locking portion 2400 may be located at the uppermost position among positions in which the jaw locking portion 2400 can be located.

Referring to FIG. 13A, when the front cover 2000 for helmets (jaw protection portion) is in a lowered position, the jaw locking portion 2400 may be located in a free position or in a limited position.

When the front cover 2000 for helmets (jaw protection portion) is in the lowered position, the second mediation limiting portion 2232 may not be inserted into the jaw locking recess portion P2430 at any position where the jaw locking portion 2400 is positioned.

However, the second mediation limiting portion 2232 and the second jaw locking portion 2420 at one side of the jaw locking recess portion P2430 may contact each other.

Referring to FIG. 13B, when the front cover 2000 for helmets is in a lowered position, and the jaw locking portion 2400 is located at the limited position, the jaw protection portion 2100 is opened to the upward position and is moved in position, while the second jaw locking portion 2420 is rotated together with the jaw protection portion 2100, and the second jaw locking portion 2420 may interfere with the second mediation limiting portion 2232.

Referring to FIG. 13C, when the jaw protection portion 2100 is continuously moved to the raised position, the jaw locking portion 2400 is rotated while being pushed by the second mediation limiting portion 2232 so that it can be located in a free position.

Therefore, no matter where the jaw locking portion 2400 is located, when the front cover 2000 for helmets is moved from the lowered position to the raised position, the jaw locking portion 2400 may be located at a free position.

Figure 14A:
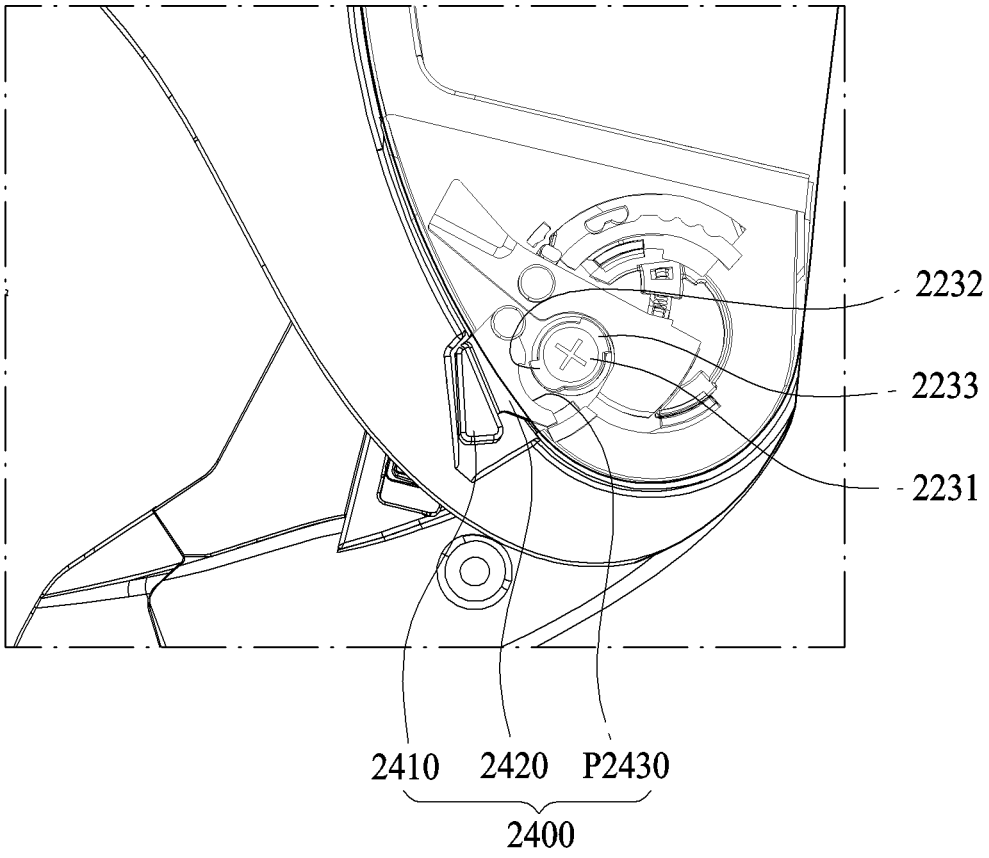
FIGS. 14A and 14B are views for explaining a locking function of a jaw locking portion of the front cover for the helmet according to an embodiment of the present invention.
Figure 14B:
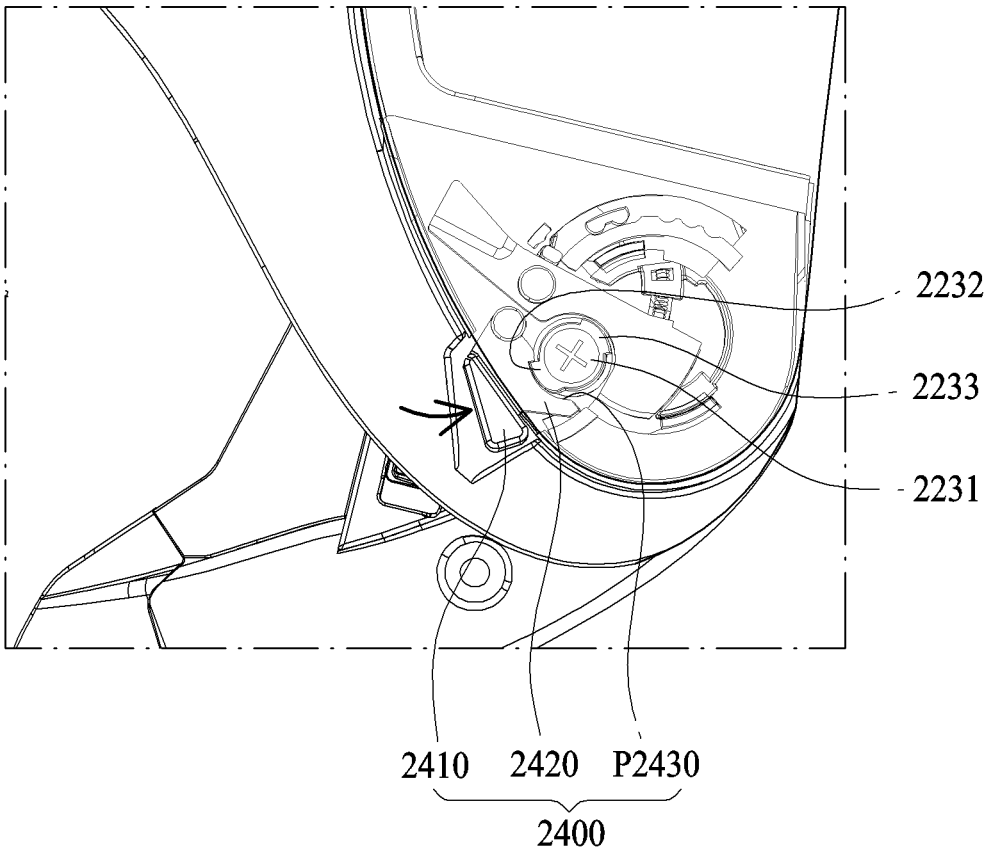

FIGS. 14A and 14B are views for explaining the locking function of the jaw locking portion 2400 provided in the front cover 2000 for helmets according to an embodiment of the present invention.

When the jaw locking portion 2400 is in a free position, the jaw locking portion 2400 may not be able to restrict rotation of the jaw protection portion (see 2100 of FIG. 4) with respect to the shell 1000 for a helmet.

When the jaw locking portion 2400 is in the limited position, the jaw locking portion 2400 may limit rotation of the jaw protection portion 2100, which is in a raised position, based on the shell 1000 for a helmet.

When the jaw locking portion 2400 is in a free position, and when the jaw protection portion 2100 is rotated based on the shell 1000 for a helmet, the jaw locking portion 2400 may not interfere with the mediation limiting portion 2232.

In addition, when the jaw locking portion 2400 is in the limited position, the jaw locking portion 2400 interferes with the mediation limiting portion 2232 so that the jaw protection portion 2100 in a raised position cannot be rotated based on the shell 1000 for a helmet.

When the jaw protection portion 2100 is in the raised position, the second jaw locking portion 2420 may have a jaw locking recess portion P2430 into which the second mediation limiting portion 2232 can be inserted.

As a specific example, referring to FIG. 14A, when the front cover 2000 for helmets (jaw protection portion) is in the raised position and the jaw locking portion 2400 is in the free position, the jaw locking recess portion P2430 may not cover the second mediation limiting portion 2232.

For this reason, referring to the drawing, when the front cover 2000 for helmets (jaw protection portion) is in the raised position and the jaw locking portion 2400 is in the free position, and when a predetermined lower external force or more is applied to the front cover 2000 for helmets, the front cover 2000 for helmets may be rotated in a downward direction.

Conversely, referring to FIG. 14B, the wearer may apply an external force to the first jaw locking portion 2410 to move the jaw locking portion 2400 from a free position to a limited position.

When the front cover 2000 for helmets (jaw protection portion) is in the raised position and the jaw locking portion 2400 is in the limited position, the jaw locking recess portion P2430 is outwardly inserted to the second mediation limiting portion 2232 so that the jaw protection portion 2100 may not be able to rotate together with the jaw locking portion 2400.

Accordingly, even when a predetermined lower external force or more is applied to the front cover 2000 for helmets, the front cover 2000 for helmets may not be able to rotate in the downward direction.

The jaw locking portion 2400 may be present only on one side of the jaw protection portion 2100.

However, the present invention is not limited thereto, and the jaw locking portion 2400 may be present on two sides of the jaw protection portion 2100.

When it is assumed that the jaw locking portion 2400 exists only on one side of the jaw protection portion 2100, the jaw mediation portion 2200 of the part where the jaw protection portion 2100 does not exist is not provided with the second mediation limiting portion 2232 and the third mediation limiting portion 2233 but is only provided with the first mediation limiting portion 2231.

The wearer can conveniently position the front cover 2000 for helmets in a raised position and thus can wear various helmet types according to his or her preference.

Figure 15:
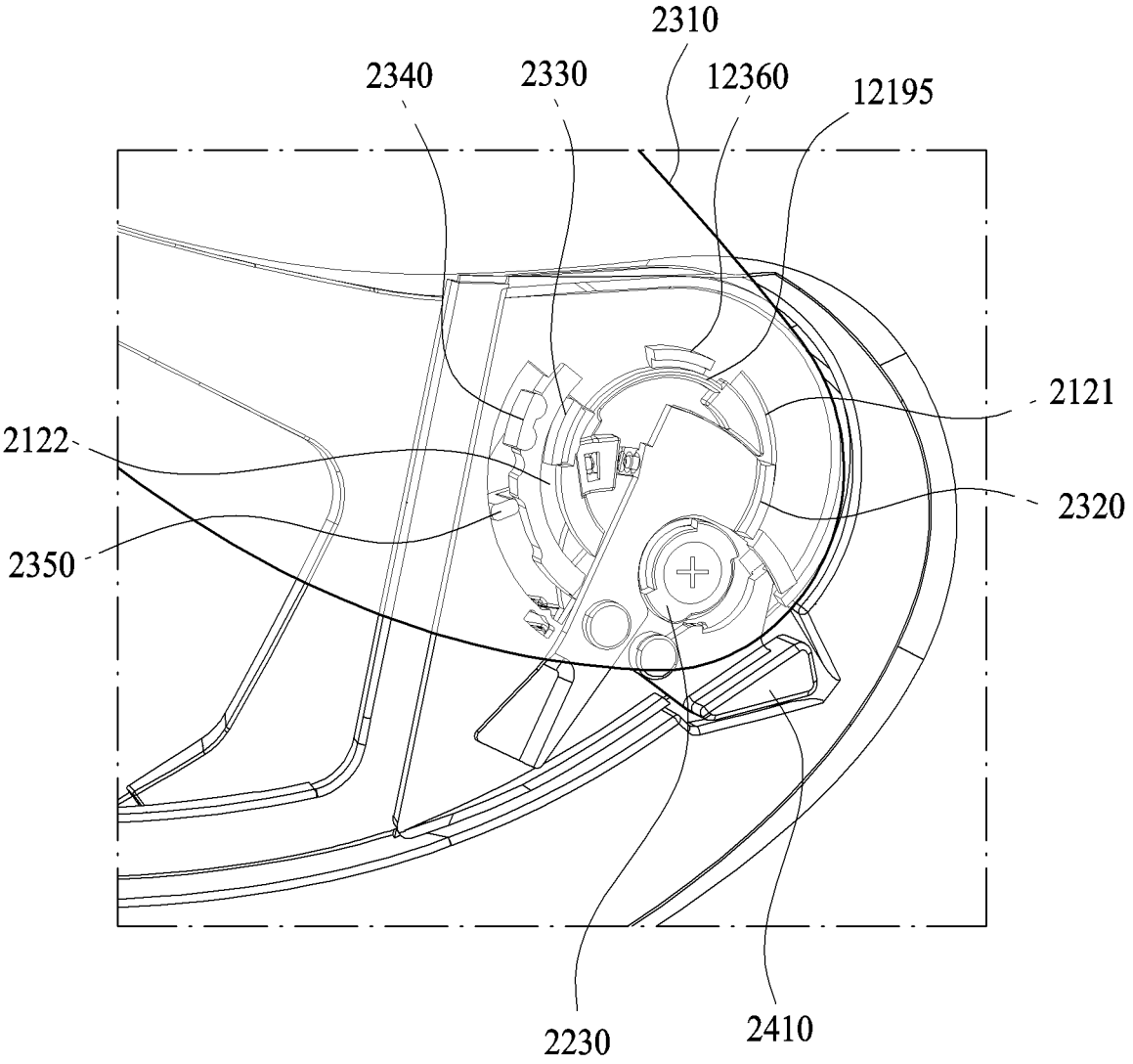
FIG. 15 is a view showing a side of a helmet according to another embodiment of the present invention.

FIG. 15 is a side view of a helmet according to another embodiment of the present invention.

The shield portion 2300 included in the front cover 2000 for helmets of the helmet according to another embodiment of the present invention may further include a fifth protrusion 12360 protruding from the inner surface of the shield body portion 2310.

In addition, the jaw protection portion 2100 included in the front cover 2000 for helmets of the helmet according to another embodiment of the present invention may further include a sliding portion 12195 protruding from the outer surface of the jaw protection seating portion 2120.

The sliding portion 12195 may be formed to be round by connecting the first guide portion 2121 and the second guide portion 2122 to each other.

The fifth protrusion 12360 may be in contact with one side of the sliding portion 12195, and as the shield body portion 2310 is moved, the fifth protrusion 12360 can be slid on the sliding portion 12195.

The sliding portion 12195 may support the fifth protrusion 12360.

For this reason, the shield portion 2300 can be smoothly rotated based on the jaw protection portion 2100.

Hereinafter, a detailed description of the helmet according to another embodiment of the present invention may be omitted to extent that it overlaps with the above description.

Unlike the above example, in the helmet according to another embodiment of the present invention, a jaw mediation portion may be connected to a shell for the helmet, and a shell mediation portion may be formed on a front cover for the helmet.

Specifically, the shell for the helmet included in the helmet according to another embodiment of the present invention may include a shell body portion and a jaw mediation portion connected to the shell body portion and rotated based on the shell body portion.

The jaw mediation portion may include a jaw mediation body portion and a shaft portion connecting the jaw mediation body portion and the shell body portion so that the jaw mediation body portion can be rotated based on the shell body portion.

The jaw mediation portion can be rotated by protruding from the side of the shell body portion.

A detailed description of the structure of the jaw mediation body portion may be omitted to the extent that it overlaps with the above-described contents.

The front cover for helmets included in the helmet according to another embodiment of the present invention may include a jaw protection portion, a shell mediation portion connected to an inner surface of the jaw protection seating portion of the jaw protection portion, and a shield portion.

The shell mediation portion may provide a space opened in one direction and inward so that the jaw mediation body portion may be inserted or withdrawn.

A detailed description of the structure of the shell mediation portion may be omitted to the extent that it overlaps with the above description.

Hereinafter, a detailed description may be omitted to the extent that it overlaps with the above description.

A front cover for helmets, a shell for a helmet, and a helmet including the same according to the present invention can be changed to various shapes according to reference.

Also, it is easy to change a type thereof.

The effects of the present invention are not limited to the above-described effects, and effects that are not mentioned will be clearly understood by those of ordinary skill in the art from the present specification and the accompanying drawings.

In the accompanying drawings, in order to more clearly express the technical spirit of the present invention, components not related or inferior to the technical spirit of the present invention are briefly expressed or omitted.

Although the configuration and features of the present invention have been described based on embodiments of the present invention as described above, the present invention is not limited thereto, and it will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A front cover for a helmet slidably connectable to a shell of the helmet for covering an upper side, a rear side, and two sides of the head of a wearer so as to protect the upper side, the rear side, and two sides of the head of the wearer, the front cover comprising:

a jaw protection portion configured to protect the wearer's jaw when the front cover is connected to the shell; and a jaw mediation portion connected to the jaw protection portion and configured to serve to mediate the jaw protection portion and the shell by being connected to the shell, the jaw mediation portion comprising:

a locking recess portion formed by part of a side surface of the jaw mediation portion being recessed so that, when the front cover is slidably connected to the shell, a shell locking portion provided by the shell is inserted so that the front cover is prevented from being separated from the shell, a jaw mediation body portion, and a shaft portion configured to connect the jaw mediation body portion and the jaw protection portion so that the jaw mediation body portion is rotatable with respect to the jaw protection portion, wherein, when the jaw protection portion is connected to the shell by the jaw mediation portion, the jaw protection portion is rotatable based on the shell.

2. The front cover of claim 1, wherein the jaw mediation portion is rotatably connected to the jaw protection portion.

3. The front cover of claim 2, wherein the jaw mediation portion is connected to at least one end of both ends of the jaw protection portion so as to protrude from an inner surface of the end of the jaw protection portion.

4. The front cover of claim 2, further comprising a jaw locking portion that is connected to the jaw protection portion, rotates together with the jaw protection portion, and is movable in position based on the jaw protection portion when the front cover is connected to the shell, wherein, when the jaw locking portion is in a free position, the jaw locking portion does not restrict rotation of the jaw protection portion with respect to the shell, and when the jaw locking portion is in a limited position, the jaw locking portion restricts rotation of the jaw protection portion in a raised position with respect to the shell.

5. The front cover of claim 4, wherein the jaw mediation portion comprises a jaw mediation body portion, a shaft portion configured to connect the jaw mediation body portion and the jaw protection portion so that the jaw mediation body portion is rotatable with respect to the jaw protection portion, and a mediation limiting portion connected to the shaft portion, and when the jaw locking portion is in the free position, the jaw locking portion does not interfere with the mediation limiting portion when the jaw protection portion is rotated with respect to the shell, and when the jaw locking portion is in the limited position, the jaw locking portion interferes with the mediation limiting portion so that the jaw protection portion in the raised position is not rotatable with respect to the shell.

6. The front cover of claim 5, wherein the mediation limiting portion comprises a first mediation limiting portion connected to the shaft portion and a second mediation limiting portion protruding from the first mediation limiting portion in one direction, and the jaw locking portion comprises a first jaw locking portion for receiving an external force for positional movement, and a second jaw locking portion connected to the first jaw locking portion, and when the jaw protection portion is in the raised position, a jaw locking recess portion, into which the second mediation limiting portion is inserted, is formed in the second jaw locking portion.

7. The front cover of claim 1, further comprising a shield portion connected to the jaw protection portion so that, when the front cover is connected to the shell, the wearer's eyes are allowed to be protected, wherein the shield portion is detachably attached to the jaw protection portion.

8. The front cover of claim 1, wherein the jaw protection portion, and the jaw mediation body portion comprises a first jaw mediation body portion positioned adjacent to the jaw protection seating portion and a second jaw mediation body portion connected to the first jaw mediation body portion so that a bottom surface of the first jaw mediation body portion is included in a top surface of the second jaw mediation body portion, and the locking recess portion is formed in the second jaw mediation body portion.

9. A front cover for a helmet connectable to a shell of the helmet for covering an upper side, a rear side, and two sides of the head of a wearer so as to protect the upper side, the rear side, and two sides of the head of the wearer, the front cover comprising:

a jaw protection portion configured to protect the wearer's jaw when the front cover is connected to the shell;

a jaw mediation portion connected to the jaw protection portion and configured to serve to mediate the jaw protection portion and the shell by being connected to the shell; and a shield portion connected to the jaw protection portion so that, when the front cover is connected to the shell, the wearer's eyes are allowed to be protected, wherein the shield portion is detachably attached to the jaw protection portion, wherein, when the jaw protection portion is connected to the shell by the jaw mediation portion, the jaw protection portion is rotatable based on the shell, and wherein the jaw protection portion comprises a jaw protection body portion configured to protect the wearer's jaw when the front cover is connected to the shell, a jaw protection seating portion connected to at least one end of the jaw protection body portion and configured to provide a certain area in which the shield portion is seated, and a coupling portion configured to determine whether to connect the shield portion and the jaw protection seating portion through positional movement, and when the coupling portion is in a locked position, the coupling portion limits position movement of the shield portion so that the shield portion connected to the jaw protection seating portion is not separated from the jaw protection seating portion, and when the coupling portion is in a released portion, the coupling portion limits positional movement of the shield portion so that the shield portion connected to the jaw protection seating portion is separated from the jaw protection seating portion.

10. The front cover of claim 9, wherein, when the shield portion is connected to the jaw protection seating portion, the shield portion is rotatable based on the jaw protection seating portion, and when the shield portion is located in an open position, the coupling portion is partially concealed by the shield portion and connected to the jaw protection seating portion so that the remaining part is exposed to the outside.

11. The front cover of claim 10, wherein the shield portion comprises a shield body portion and a first protrusion protruding from an inner surface of the shield body portion seated on the jaw protection seating portion, and the jaw protection seating portion comprises a first guide portion that is recessed to a certain depth so that the first protrusion is inserted and moved in position so that the shield portion is rotatable with respect to the jaw protection seating portion, and when the coupling portion is in the locked position, part of the coupling portion is disposed above the first guide portion, and the coupling portion prevents the first protrusion inserted into the first guide portion from deviating from the first guide portion, and when the coupling portion is in the released position, all parts of the coupling portion are not disposed above the first guide portion, and the first protrusion inserted into the first guide portion is separable from the first guide portion.

12. The front cover of claim 11, wherein the jaw protection portion further comprises a first movement limiting portion that protrudes from the jaw protection seating portion and is positioned above the first guide portion so that, when the first protrusion is inserted into the first guide portion, the first protrusion is prevented from deviating from the first guide portion, and when the shield portion is in the open position, the first protrusion is positioned in a position corresponding to the coupling portion, and when the shield portion is in a protected position, the first protrusion is positioned in a position corresponding to the first movement limiting portion.

13. The front cover of claim 12, wherein the shield portion further comprises a second protrusion protruding from an inner surface of the shield body portion seated on the jaw protection seating portion, and the jaw protection seating portion comprises a second guide portion that is recessed to a certain depth so as to be spaced apart from the first guide portion so that the second protrusion is inserted and moved in position so that the shield portion is rotatable with respect to the jaw protection seating portion, and the jaw protection portion further comprises a second movement limiting portion that protrudes from the jaw protection seating portion and is disposed above the second guide portion so that, when the second protrusion is inserted into the second guide portion, the second protrusion is prevented from deviating from the second guide portion, and when the shield portion is in the open position, the second protrusion deviates from the upper side of the second guide portion, and when the shield portion is in a protected position, the second protrusion is positioned in a position corresponding to the second movement limiting portion.

14. The front cover of claim 9, wherein the jaw protection portion further comprises a jaw elastic portion configured to provide an elastic force to the coupling portion so that, when no external force is applied to the coupling portion, the coupling portion is held in the locked position.

15. A shell for a helmet to which a front cover of the helmet is slidably detachably attached and which is configured to cover an upper side, a rear side, and two sides of the head of the wearer so as to protect the upper side, the rear side, and two sides of the head of the wearer, the front cover comprising:

a jaw protection portion allowing the jaw of a wearer to be protected, and a jaw mediation portion connected to the jaw protection portion, the jaw mediation portion comprising:

a locking recess portion formed by part of a side surface of the jaw mediation portion being recessed so that, when the front cover is slidably connected to the shell, a shell locking portion provided by the shell is inserted so that the front cover is prevented from being separated from the shell, a jaw mediation body portion, and a shaft portion configured to connect the jaw mediation body portion and the jaw protection portion so that the jaw mediation body portion is rotatable with respect to the jaw protection portion, and the shell comprising:

a shell body portion configured to provide a certain space inside and communication with the outside so that the upper side, the rear side, and two sides of the head of the wearer are covered;

a shell mediation portion that is connected to the shell body portion and connectable to the jaw mediation portion; and a shell locking portion that is connected to the jaw mediation portion so as to prevent the jaw mediation portion from being moved in a second direction that is opposite to a first direction and to prevent the jaw mediation portion from being separated from the shell mediation portion when the jaw mediation portion is moved in the first direction and connected to the shell mediation portion.

16. The shell of claim 15, wherein, when the shell locking portion is in a protruding position, the shell locking portion is inserted into a locking recess portion recessed into the jaw mediation portion, and when the shell locking portion is in a spaced position, the shell locking portion is spaced apart from the locking recess portion.

17. The shell of claim 15, wherein the shell mediation portion comprises a first shell mediation portion connected to the shell body portion and a second shell mediation portion connected to a top surface of the first shell mediation portion, and the first shell mediation portion provides an inner space opened in a front direction of the shell body portion and in an upward direction of a side surface of the shell body portion, and the second shell mediation portion provides an inner space opened in the front direction of the shell body portion and in the upward direction of the side surface of the shell body portion and is connected to the first shell mediation portion so that an inner surface of the first shell mediation portion and an inner surface of the second shell mediation portion form multiple stages.

18. A helmet comprising:

a shell body portion configured to provide a certain space inside and communication with the outside so that the upper side, the rear side, and two sides of the head of the wearer are covered;

a shell mediation portion connected to the shell body portion; and a front cover slidably connectable to the shell body, the front comprising:

a jaw protection portion allowing the jaw of the wearer to be protected; and a jaw mediation portion connected to the jaw protection portion, connected to the shell mediation portion and configured to connect the jaw protection portion and the shell mediation portion, the jaw mediation portion comprising:

a locking recess portion formed by part of a side surface of the jaw mediation portion being recessed so that, when the front cover is slidably connected to the shell, a shell locking portion provided by the shell is inserted so that the front cover is prevented from being separated from the shell, a jaw mediation body portion, and a shaft portion configured to connect the jaw mediation body portion and the jaw protection portion so that the jaw mediation body portion is rotatable with respect to the jaw protection portion, wherein the jaw mediation portion is rotatably connected to the jaw protection portion so that the jaw protection portion is rotatable with respect to the shell body portion.

* * * * *